US009024978B2

(12) United States Patent
Sehata et al.

(10) Patent No.: US 9,024,978 B2
(45) Date of Patent: May 5, 2015

(54) DISPLAY DEVICE

(75) Inventors: Hiroko Sehata, Sapporo (JP); Hajime Akimoto, Kokubunji (JP); Yoshihiro Kotani, Chiba (JP); Gou Yamamoto, Mobara (JP)

(73) Assignees: Japan Display Inc., Tokyo (JP); Canon Kabushiki Kaisha, Tokyo (JP)

( * ) Notice: Subject to any disclaimer, the term of this patent is extended or adjusted under 35 U.S.C. 154(b) by 1078 days.

(21) Appl. No.: 12/951,137

(22) Filed: Nov. 22, 2010

(65) Prior Publication Data

US 2011/0122173 A1 May 26, 2011

(30) Foreign Application Priority Data

Nov. 24, 2009 (JP) ..... 2009-266826

(51) Int. Cl.
*G09G 3/32* (2006.01)
*G09G 3/20* (2006.01)

(52) U.S. Cl.
CPC ..... *G09G 3/2092* (2013.01); *G09G 3/2007* (2013.01); *G09G 3/3208* (2013.01); *G09G 2310/0275* (2013.01); *G09G 2310/0297* (2013.01); *G09G 2330/028* (2013.01)

(58) Field of Classification Search
USPC ..... 345/204, 690
See application file for complete search history.

(56) References Cited

U.S. PATENT DOCUMENTS 6,097,362 A * 8/2000 Kim ..... 345/87
6,333,729 B1 * 12/2001 Ha ..... 345/98
6,958,745 B2 * 10/2005 Murase et al. ..... 345/100
7,505,017 B1 * 3/2009 Yeo et al. ..... 345/88
8,031,155 B2 * 10/2011 Jeoung et al. ..... 345/98

(Continued)

FOREIGN PATENT DOCUMENTS

CN 1855210 11/2006
JP 2002-258813 9/2002

(Continued)

OTHER PUBLICATIONS

Partial English language translation of Office Action for Japanese Patent Appln. No. 2009-266826, dated Apr. 8, 2014 (1 pg.).

*Primary Examiner* — Grant Sitta

(74) *Attorney, Agent, or Firm* — Lowe Hauptman & Ham, LLP

(57) ABSTRACT

Provided is a display device having plural data line voltage generation circuits capable of supplying a display control voltage to display elements of a color designated as necessary. The display device includes plural display elements each displaying an image of one color; plural gradation voltage output units provided for each color to output a gradation voltage corresponding to each display gradation value of a gradation number; plural display control voltage supply units connected to each of two or more display elements to supply control voltages corresponding to display data of the display elements to each of the display elements based on the gradation voltages of the gradation number output by any one of the gradation voltage output units; and plural gradation voltage selection units provided to one or each display control voltage supply unit to select the gradation voltage output by any one of the gradation voltage output units.

12 Claims, 14 Drawing Sheets

(56) References Cited

U.S. PATENT DOCUMENTS

| | | | | |
|---|---|---|---|---|
| 8,330,700 | B2 * | 12/2012 | Yamanaka et al. | 345/100 |
| 8,395,564 | B2 * | 3/2013 | Shin et al. | 345/76 |
| 2002/0140664 | A1 * | 10/2002 | Enomoto et al. | 345/103 |
| 2004/0212632 | A1 | 10/2004 | Inada et al. | |
| 2006/0007073 | A1 * | 1/2006 | Kwak et al. | 345/76 |
| 2006/0232539 | A1 | 10/2006 | Hashimoto | |
| 2007/0080914 | A1 * | 4/2007 | Sun et al. | 345/88 |

FOREIGN PATENT DOCUMENTS

| | | |
|---|---|---|
| JP | 2002-297109 | 10/2002 |
| JP | 2003-076334 | 3/2003 |
| JP | 2005-108528 | 4/2005 |
| JP | 2006-011429 | 1/2006 |
| JP | 2008-514976 | 5/2008 |
| JP | 2009-075602 | 4/2009 |
| KR | 10-2004-0092473 | 11/2004 |

* cited by examiner

DISPLAY DEVICE

CROSS-REFERENCE TO RELATED APPLICATION

The present application claims priority from Japanese patent application JP 2009-266826 filed on Nov. 24, 2009, the content of which is hereby incorporated by reference into this application.

BACKGROUND OF THE INVENTION

1. Field of the Invention

The present invention relates to a display device that displays an image of plural colors. More particularly, the present invention relates to a display device capable of realizing a high-definition display panel while maintaining display quality.

2. Description of the Related Art

In a display device in which a plurality of display elements is arranged on a display panel in a matrix form, active-matrix driving is generally used in which, when switching elements arranged in the respective display elements are sequentially turned on by scanning lines connected to the switches of the switching elements, display control voltages corresponding to display data are supplied to the respective display elements through data signal lines connected to the input side of the switching elements.

These display elements are display elements that display images of any one of the three colors of red, green, and blue, and one pixel is constituted by adjacent display elements of the three colors which are sequentially arranged. The respective pixels are generally repeatedly arranged in the vertical and horizontal directions.

In this case, generally, one data signal line is connected to a plurality of pixels arranged in the vertical direction, and between the data signal line and each of the display elements of the three colors, an element-select switching element of the corresponding color is connected. Between the display element of each color and the element-select switching element of the corresponding color, a sub-data signal line is connected. A pixel data write period which is a period where display control voltages corresponding to display data are supplied to one pixel is divided into three sub-periods, the element-select switching elements of the corresponding colors are sequentially turned on during each of the three sub-periods When the element-select switching element is turned on during the corresponding sub-period, a display control voltage corresponding to the display data is supplied to the corresponding display element of the corresponding color of the pixel.

Display control voltages corresponding to display data which will be written to the corresponding display elements of the corresponding pixels are sequentially applied to the data signal lines by a data signal line driving circuit. The display data of the respective display elements of the respective pixels are input to the data line driving circuit as digital signals. The data line driving circuit includes a plurality of data line voltage generation circuits corresponding to the respective data signal lines. Each data line voltage generation circuit includes a DA converter that converts the display data (digital signal) of the corresponding display element to a display control voltage which will be applied to the corresponding data signal line. The DA converter is generally called a decoder.

The display data is described as a gradation value corresponding to display luminance. For example, in the case of 6-bit gradation, the gradation value is any value from 0 to 63. Generally, the higher the luminance, the larger the gradation value it expresses is. A gradation voltage, which is a display control voltage that should be applied to a data signal line so as to correspond to a certain gradation value, is different for each color. Therefore, a gradation voltage generation circuit unit that outputs gradation voltages for all gradations for each of the three colors is provided in the display device.

FIG. 14A is a schematic circuit diagram showing pixels which are arranged in a general pixel arrangement and a data line driving circuit 11 which supplies display control voltages to these pixels, both of which are provided in a display device according to the related art. FIG. 14B is a diagram showing changes over time in the driving of element-select switching elements and the data line driving circuit 11 shown in FIG. 14A.

As described above, element-select switching elements of the colors of red, green, and blue are sequentially turned on during a data write period for these pixels, and data line voltage generation circuits 20 sequentially supply display control voltages to the display elements of the colors of red, green, and blue of the corresponding pixels through corresponding data signal lines 100 and corresponding sub-data signal lines 101. That is, a plurality of the data line voltage generation circuits 20, which is provided in the data line driving circuit 11, simultaneously applies display control voltages corresponding to the display elements of the same color of the three colors to each of the corresponding data signal lines 100. Moreover, each DA converter, which is provided in each of the data line voltage generation circuits 20, simultaneously selects and outputs a gradation voltage out a gradation number of graduation voltages output by the gradation voltage generation circuit unit of the same color.

SUMMARY OF THE INVENTION

However, with the increase in the definition of the display panel, there is a need for a plurality of data line voltage generation circuits to output voltages corresponding to display data of different colors simultaneously at data write timing rather than all of the data line voltage generation circuits outputting voltages corresponding to display data of the same color.

For example, as will be described later, in an organic EL display device, this is the case where display elements are arranged symmetrically to neighboring sub-data signal lines in order to increase the space for wiring supplying electrical current to organic EL elements.

In this case, each of the plurality of data line voltage generation circuits, which is provided in the data line driving circuit, requires a data line voltage generation circuit that converts an input digital signal to a voltage corresponding to a gradation value of the digital signal using a gradation voltage corresponding to each of the gradation values generated by the gradation voltage generation circuit unit of a color designated from a plurality of colors as necessary.

JP 2002-258813 A and JP 2009-75602 A disclose inventions regarding a plurality of DA converters corresponding to the gradation voltage generation circuit units of the plurality of colors.

According to the invention disclosed in JP 2002-258813 A, a gradation voltage generation circuit unit is provided for each of a plurality of colors which are the three colors of red, green, and blue, for example, and gradation voltages generated by the respective gradation voltage generation circuit units are output to the respective corresponding DA converters. According to such a configuration, the DA converter can perform DA conversion for a color corresponding to the DA converter but cannot perform DA conversion for a color designated from the plurality of colors as necessary.

The gradation voltage generation circuit unit generally includes a reference gradation voltage generation circuit (buffer circuit), which generates several gradation voltages corresponding to several reference gradation values from a gradation number as reference gradation voltages, and a gradation voltage ingenerating circuit, which generates gradation voltages corresponding to all gradation values by amplifying the reference gradation voltages using amplifiers and dividing between the adjacent reference gradation voltages using resistors connected in series.

According to the invention disclosed in JP 2009-75602 A, a reference gradation voltage generation circuit (buffer circuit) is provided for each of two or more colors, and control switching elements are provided between the plurality of reference gradation voltage generation circuits (buffer circuits) and one gradation voltage ingenerating circuit. When control switching elements of a corresponding color are turned on by a control signal synchronous to a display color, gradation voltages of the color are generated and output to a plurality of DA converters. According to such a configuration, the plurality of DA converters can perform DA conversion for colors designated at respective times. However, different DA converters cannot perform DA conversion for different colors at the same time.

The present invention has been made in view of the problems, and aims to provide a display device having a plurality of data line voltage generation circuits capable of supplying display control voltages to display elements of a color designated from a plurality of colors as necessary.

(1) To achieve the above object, there is provided a display device including: a plurality of display elements each displaying an image of any color of two or more colors; a plurality of gradation voltage output units each provided for one of the above number of colors so as to output a gradation voltage corresponding to each of display gradation values of a predetermined gradation number; a plurality of display control voltage supply units each connected to each of two or more display elements among the plurality of display elements so as to supply a control voltage corresponding to display data of each of the display elements to each of the display elements based on the gradation voltages of the gradation number output by any one of the plurality of gradation voltage output units; and a plurality of gradation voltage selection units each provided to one or more display control voltage supply units so as to select the gradation voltages output by any one of the plurality of gradation voltage output units.

(2) In the display device according to (1), each of the plurality of gradation voltage selection units may select any one of the plurality of gradation voltage output units in accordance with the color of the display elements which are supplied with the control voltages by the corresponding one or more display control voltage supply units.

(3) In the display device according to (1) or (2), each of the plurality of gradation voltage selection units may be provided to the corresponding one display control voltage supply unit.

(4) In the display device according to (1) or (2), each of the plurality of gradation voltage selection units may be provided to the corresponding two or more display control voltage supply units.

According to the present invention, due to the display device having a plurality of data line voltage generation circuits capable of supplying display control voltages to display elements of a color designated from a plurality of colors as necessary, it is possible to realize a high-definition display panel while maintaining display quality.

DETAILED DESCRIPTION OF THE INVENTION

A display device according to embodiments of the present invention will be described with reference to the drawings.

First Embodiment

Figure 1:
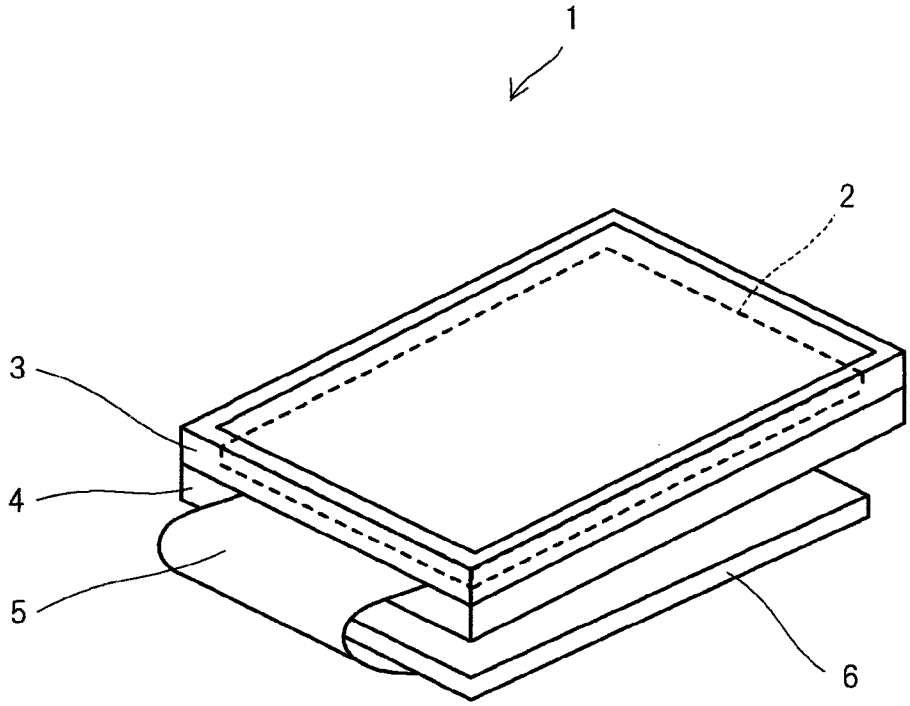
FIG. 1 is a perspective view of a main part of an organic EL display device according to a first embodiment of the present invention.

FIG. 1 is a perspective view of a main part of an organic EL display device 1 according to a first embodiment of the present invention. As shown in FIG. 1, the organic EL display device 1 includes an upper frame 3 and a lower frame 4 which are fixed so as to interpose an organic EL panel including a TFT (Thin Film Transistor) substrate 2 and a sealing substrate (not shown), a circuit board 6 in which a control circuit such as a driving circuit is provided, and a flexible board 5 which transfers display data generated in the circuit board 6 to the TFT substrate 2. Moreover, an electrical current, voltage and the like necessary for the organic EL panel to display an image are supplied to the circuit board 6 by a power supply circuit through the flexible board 5.

Figure 2:
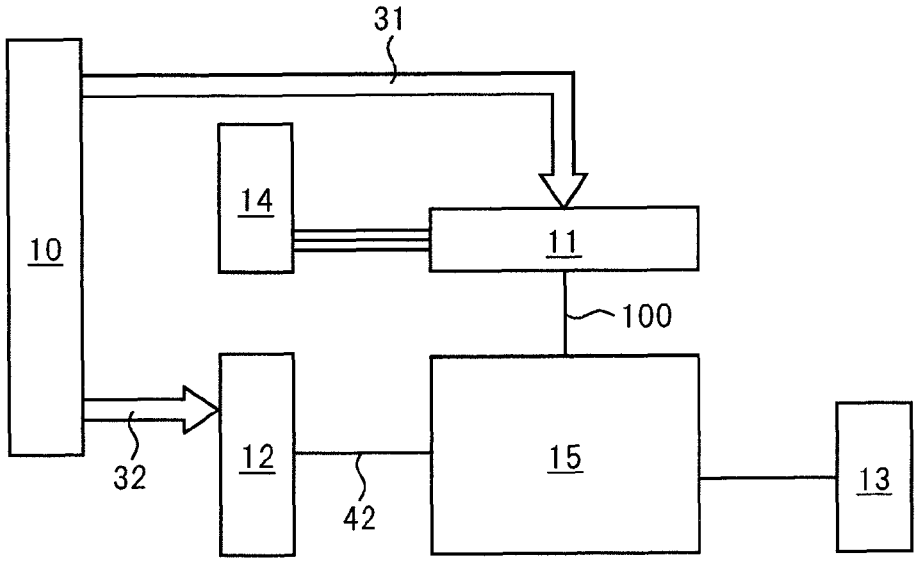
FIG. 2 is a schematic diagram showing a display driving system of the organic EL display device according to the first embodiment of the present invention.

FIG. 2 is a schematic diagram showing a display driving system of the organic EL display device 1 according to the first embodiment of the present invention. Display control signals including a horizontal synchronization signal, a vertical synchronization signal, a data enable signal, display data, and a synchronization clock signal are input to a display controller 10. The display controller 10 outputs data line control signals 31 and scanning line control signals 32 to a data line driving circuit 11 and a scanning line driving circuit 12, respectively, based on the input display control signals.

A plurality of pixel circuits which are arranged in a matrix form in a display region 15 are controlled by the data line driving circuit 11, the scanning line driving circuit 12, an emission voltage supply circuit 13, and the like. The respective pixel circuits are connected to the data line driving circuit 11 and the scanning line driving circuit 12 through data signal lines 100 and scanning lines 42, respectively. During a display data write period of the pixel circuits, the scanning line driving circuit 12 sequentially applies a high voltage to a plurality of the scanning lines 42. Writing of display data is performed on the pixel circuits connected to the scanning lines 42 to which the high voltage is applied. At that time, the data line driving circuit 11 supplies a display control voltage to each of the pixel circuits through the corresponding data signal lines 100. In this way, during an emission period of organic EL elements provided to the pixel circuits, the amounts of current flowing into the organic EL elements are controlled, and images are displayed.

The data line driving circuit 11 is connected to a gradation voltage generation circuit unit 14 which generates gradation voltages for each of the three colors of red, green, and blue. The gradation voltage generation circuit unit 14 supplies a gradation number of gradation voltages for each of the colors to the data line driving circuit 11. During the display data write period, the data line driving circuit 11 selects display control voltages corresponding to the color and display data of the corresponding display elements out of the gradation number of gradation voltages for each of the colors and supplies the selected display control voltages to the corresponding display elements.

Although the display controller 10, the data line driving circuit 11, and the scanning line driving circuit 12 are illustrated as individual elements in FIG. 2, the entirety or a part of these elements may be mounted on an IC.

Figure 3A:
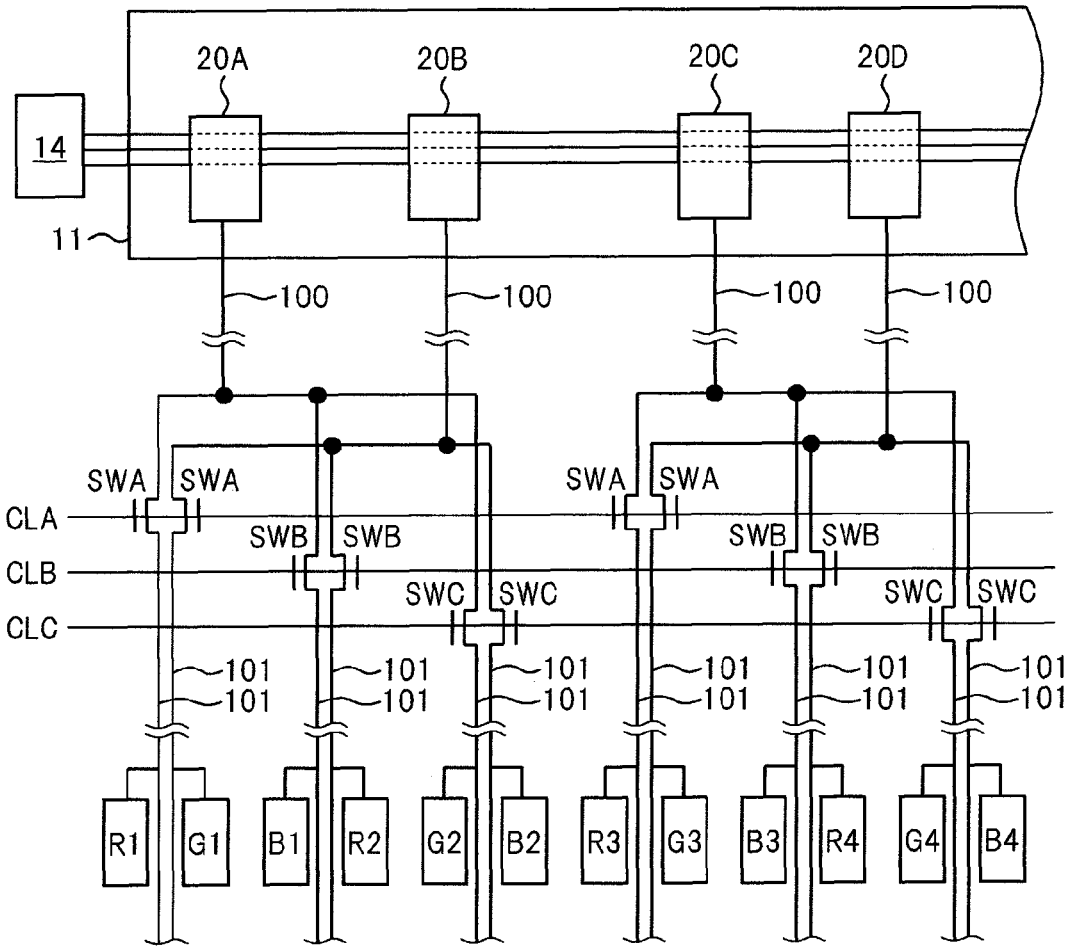
FIG. 3A is a schematic circuit diagram showing pixels which are arranged in a general pixel arrangement and a data line driving circuit which supplies display control voltages to these pixels, both of which are provided in the organic EL display device according to the first embodiment of the present invention.
Figure 3B:
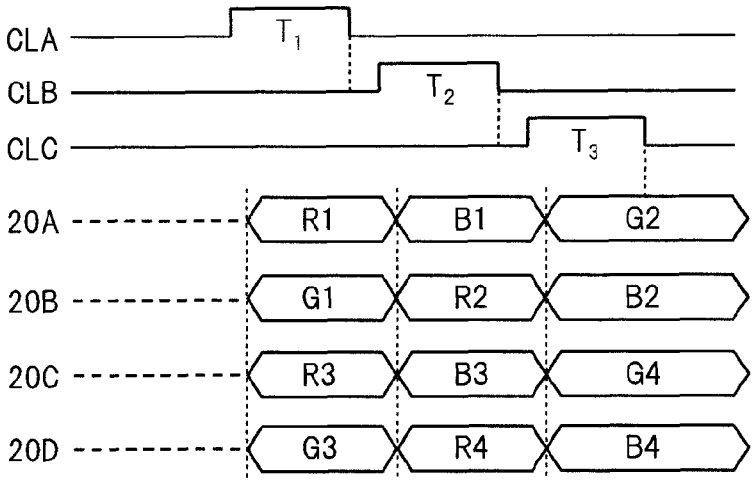
FIG. 3B is a diagram showing changes over time in the driving of element-select switching elements and the data line driving circuit shown in FIG. 3A.

FIG. 3A is a schematic circuit diagram showing pixels which are arranged in a general pixel arrangement and the data line driving circuit 11 which supplies display control voltages to these pixels, both of which are provided to the organic EL display device 1 according to the first embodiment of the present invention. FIG. 3B is a diagram showing changes over time in the driving of element-select switching elements and the data line driving circuit 11 shown in FIG. 3A.

Four pixels of a first pixel to a fourth pixel are arranged in a general pixel arrangement in that order in the horizontal direction from the left of FIG. 3A. In each of the pixels, display elements of three colors are arranged in the order of red, green, and blue from the left. For example, the first pixel includes display elements of the three colors, which are a first pixel red display element R1, a first pixel green display element G1, and a first pixel blue display element B1.

The data line driving circuit 11 includes a plurality of data line voltage generation circuits 20, and the respective data line voltage generation circuits 20 are connected to the corresponding data signal lines 100. The data line driving circuit 11 is connected to the respective display elements of the respective pixels through the corresponding data signal lines 100, the corresponding element-select switching elements, and corresponding sub-data signal lines 101.

Element select control lines are connected to the switch inputs of the element-select switching elements. The element-select switching elements are turned on when the corresponding element select control lines are at a high voltage. As shown in FIG. 3A, three kinds of element-select switching elements SWA, SWB, and SWC are respectively turned on by three element select control lines CLA, CLB, and CLC.

The sub-data signal lines 101 are paired by two sub-data signal lines 101 and are sequentially arranged. The display elements are disposed on both sides of a pair of the sub-data signal lines 101, and two display elements form a pair. The display elements are also sequentially arranged. An arrangement in which display elements are arranged on both sides of a pair of sub-data signal lines 101 is called a date signal line mirror arrangement.

Each pair of the sub-data signal lines 101 are further connected to neighboring data signal lines 100, respectively, through the element-select switching elements of the same kind. These data signal lines 100 are connected to neighboring data line voltage generation circuits 20 respectively. For example, the first pixel red display element R1 and the first pixel green display element G1 positioned on the left side of FIG. 3A are connected to neighboring first and second data line voltage generation circuits 20A and 20B, respectively, through the element-select switching elements SWA.

Each data line voltage generation circuit 20 is connected to the three display elements through the three element-select switching elements SWA, SWB, and SWC, respectively. For example, the first data line voltage generation circuit 20A positioned on the left side of FIG. 3A is connected to the first pixel red display element R1, the second pixel green display element G2, and the first pixel blue display element B1.

As shown in FIG. 3B, the pixel data write period for each pixel shown in FIG. 3A is divided into three sub-periods, which are in order periods $T_1$, $T_2$, and $T_3$. During the period $T_1$, the element select control line CLA is at a high voltage, and the element-select switching elements SWA are turned on. Similarly, during the periods $T_2$ and $T_3$, the element-select switching elements SWB and SWC are turned on, respectively.

Therefore, for example, the first data line voltage generation circuit 20A supplies a display control voltage to the first pixel red display element R1, the first pixel blue display element B1, and the second pixel green display element G2 during the periods $T_1$, $T_2$, and $T_3$, respectively. In contrast, the second data line voltage generation circuit 20B supplies a display control voltage to the first pixel green display element G1, the second pixel red display element R2, and the second pixel blue display element B2 during the periods $T_1$, $T_2$, and $T_3$, respectively. In this case, the first and second data line voltage generation circuits 20A and 20B supply display control voltages to display elements of different colors during each of the periods $T_1$, $T_2$, and $T_3$.

Figure 4:
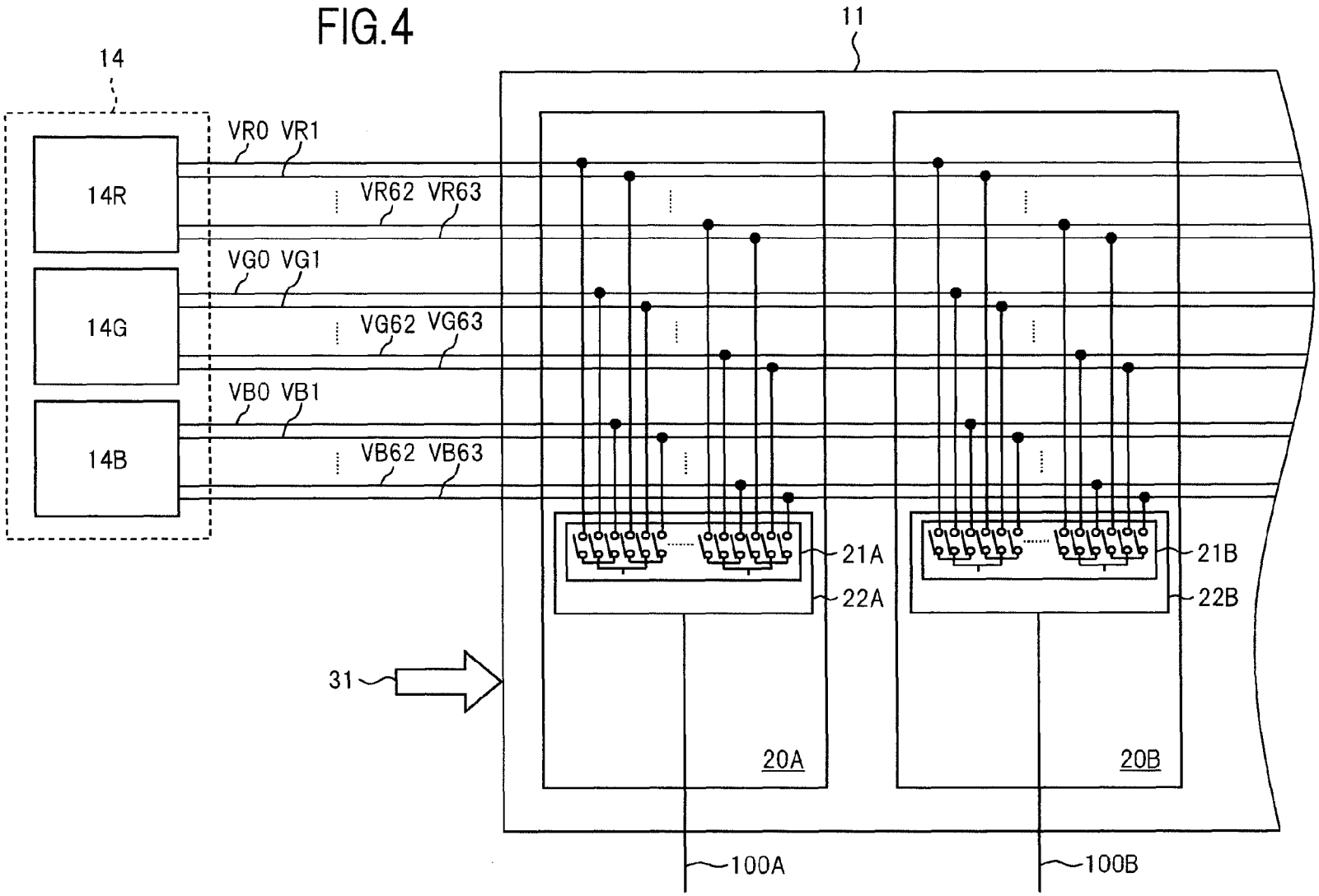
FIG. 4 is a schematic circuit diagram showing the configuration of the data line driving circuit and gradation voltage generation circuit unit according to the first embodiment of the present invention.

FIG. 4 is a schematic circuit diagram showing the configuration of the data line driving circuit 11 and the gradation voltage generation circuit unit 14 according to the first embodiment of the present invention. The three blocks shown on the left side of the figure are a red gradation voltage generation sub-circuit 14R, a green gradation voltage generation sub-circuit 14G, and a blue gradation voltage generation sub-circuit 14B, which correspond to each of the three colors of red, green, and blue. The gradation voltage generation circuit unit 14 is formed by the three sub-circuits. The gradation voltage generation sub-circuits of the respective colors output 64 gradation voltages corresponding to gradation values of 6-bit gradation, namely the gradation number 64. For example, the red gradation voltage generation sub-circuit 14R outputs 64 gradation voltages from a gradation voltage VR0 corresponding to a gradation value 0 to a gradation voltage VR63 corresponding to a gradation value 63 to 64 red gradation wires. The same applies to the green gradation voltage generation sub-circuit 14G and the blue gradation voltage generation sub-circuit 14B.

The data line driving circuit 11 is shown on the right side of the figure, and among the plurality of data line voltage generation circuits 20, the first and second data line voltage generation circuits 20A and 20B are shown in the data line driving circuit 11.

Each data line voltage generation circuit 20 includes a gradation voltage DA converter 22. Each gradation voltage DA converter 22 further includes a gradation switching circuit 21. The gradation voltages of the 64 gradation numbers output by the red, green, and blue gradation voltage generation sub-circuits 14R, 14G, and 14B are input to each gradation switching circuit 21 through the gradation wires of each color.

Each gradation switching circuit 21 includes 64 switching elements corresponding to each of the gradation values. Each of the switching elements selects any ones of three gradation voltages of the corresponding gradation value output by the red, green, and blue gradation voltage generation sub-circuits 14R, 14G, and 14B in accordance with the color of the display element, to which the display control voltage is supplied from the data line voltage generation circuit 20. For example, the switching element corresponding to a gradation value 0, selects any one of red, green, and blue gradation voltages VR0, VG0, and VB0 corresponding to the gradation value 0 as a gradation voltage V0 of the gradation value 0. In this way, the gradation switching circuit 21 selects the gradation number of gradation voltages for a color out of the 3 color gradation voltages output by the gradation voltage generation circuit unit 14 in accordance with the color of the display element.

For example, as shown in FIG. 3B, during the period $T_1$, the first and second data line voltage generation circuits 20A and 20B supply display control voltages to the first pixel red display element R1 and the first pixel green display element G1, respectively. Based on the data line control signal 31 output by the display controller 10, the data line driving circuit 11 outputs information on the color of the first pixel red display element R1 and a digital value of the display data to the first data line voltage generation circuit 20A, and outputs information on the color of the first pixel green display element G1 and a digital value of the display data to the second data line voltage generation circuit 20B. For example, a first gradation switching circuit 21A provided to the first data line voltage generation circuit 20A selects gradation voltages for red which is the color of the first pixel red display element R1.

The gradation voltage DA converter 22 selects a gradation voltage corresponding to the digital value of the display data of the corresponding display element from among the gradation voltages of the 64 gradation numbers selected by the gradation switching circuit 21 and applies the selected gradation voltage to the data signal lines 100.

Although the gradation switching circuit 21 is provided to the gradation voltage DA converter 22, the gradation switching circuit 21 may be provided to the data line voltage generation circuit 20 separated from the gradation voltage DA converter 22. In this case, from among the gradation voltages of the 64 gradation numbers for each of the colors output from the gradation voltage generation circuit unit 14, gradation voltages of the 64 gradation numbers of color of corresponding display elements are selected in accordance with the information on the color of the corresponding display elements and output to the gradation voltage DA converter 22.

As described above, since each of the gradation voltage DA converters 22 of the data line voltage generation circuits 20 includes the gradation switching circuit 21, during the display data write period, the respective data line voltage generation circuits 20 can supply display control voltages of desired colors to the display elements independently of other data line voltage generation circuits 20 in accordance with the control signal. Due to such a configuration, in the display device of the related art, the data line driving circuit 11 simultaneously supplies display control voltages to the display elements only of the same color, whereas in the display device of the present embodiment, the plurality of data line voltage generation circuits 20 provided to the data line driving circuit 11 are able to independently supply display control voltages to the corresponding display elements with respect to the display elements of different colors. Therefore, the degree of freedom in designing the display device circuit can be increased remarkably, and it is possible to cope with the increase in the definition of the display panel of the display device.

Figure 14A:
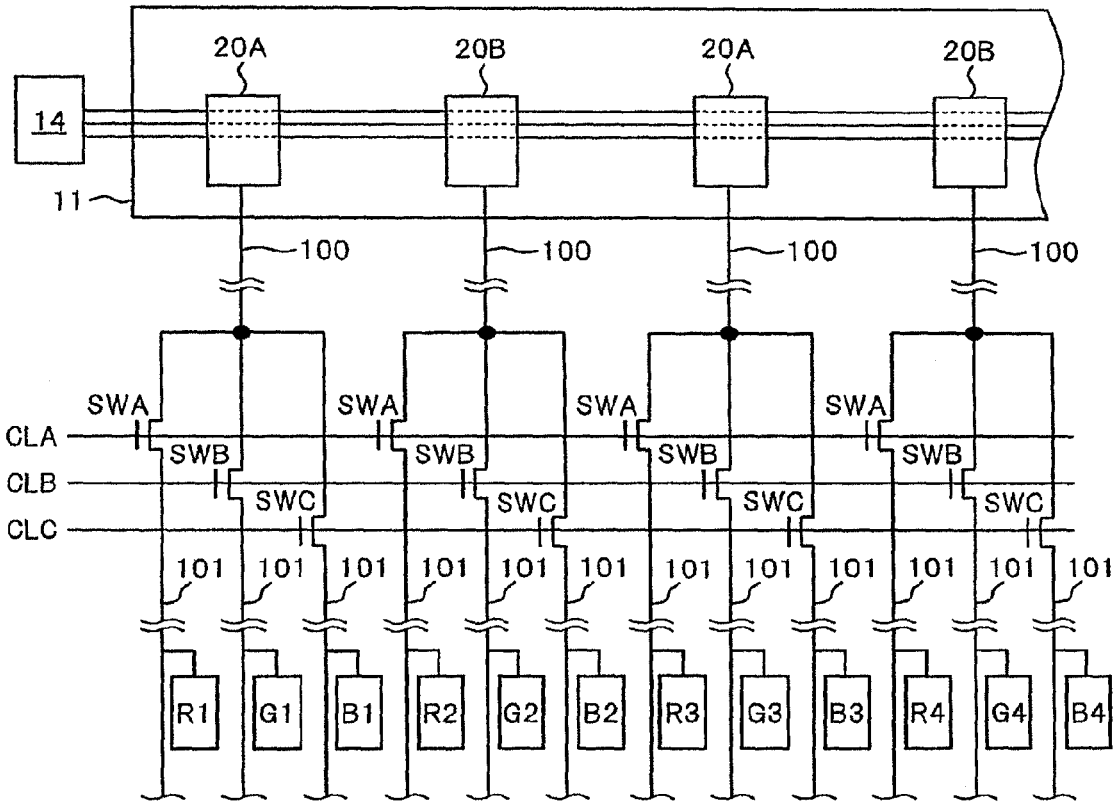
FIG.14A PRIOR ART
FIG. 14A is a schematic circuit diagram showing pixels which are arranged in a general pixel arrangement and a data line driving circuit which supplies display control voltages to these pixels, both of which are provided to a display device according to the related art.
Figure 14B:
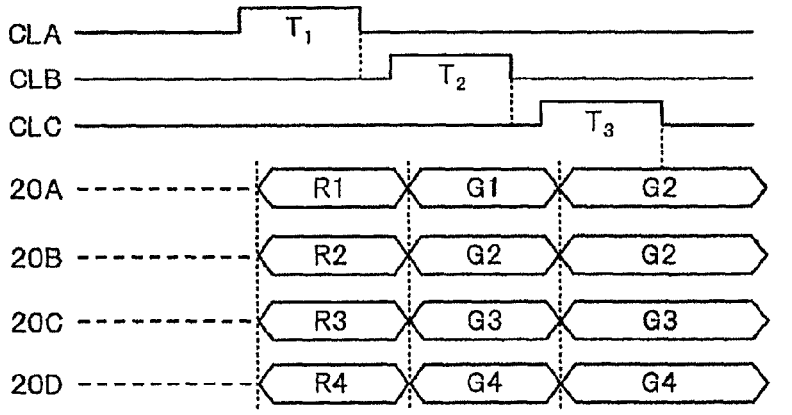
FIG.14B PRIOR ART
FIG. 14B is a diagram showing changes overtime in the driving of element-select switching elements and the data line driving circuit shown in FIG. 14A.

When images are displayed on the pixels arranged in the general pixel arrangement shown in FIG. 14A, all the gradation switching circuits 21 may be controlled so as to simultaneously select gradation voltages of the same color.

The configuration of the pixels and the data line voltage generation circuit shown in FIG. 3A is an example of a case where the data line driving circuit 11 supplies display control voltages to display elements of different colors during the same period.

In FIG. 3A, as described above, the display elements are arranged in the data signal line mirror arrangement in which they are arranged on both sides of the pair of sub-data signal lines 101. Since such an arrangement enables a space to be provided between two neighboring pairs of display elements, when the display elements are self-emitting elements, for example, the current supply wires for supplying electric currents to the self-emitting elements can be arranged in this space by suppressing an internal resistance with a wider line width than the pixel arrangement shown in FIG. 14A. Thus, such an arrangement is necessary for realizing a high-definition display panel.

As shown in FIG. 3A, when two sub-data signal lines 101 are adjacent to each other, and a display control voltage is supplied to a display element connected to one sub-data signal line 101, the other sub-data signal line 101 is also affected by noise by the display control voltage. Thus, a phenomenon called crosstalk may occur in which a part of display data is written to a display element connected to the other sub-data signal line 101, thus decreasing the display quality.

The crosstalk can be suppressed by simultaneously supplying display control voltages to a pair of display elements respectively connected to a pair of sub-data signal lines 101. FIG. 3A shows a configuration that suppresses the crosstalk.

Second Embodiment

A basic configuration of the organic EL display device 1 according to a second embodiment of the present invention is the same as the organic EL display device 1 according to the first embodiment. The organic EL display device 1 of the second embodiment of the present invention is different from the organic EL display device 1 of the first embodiment of the present invention, in that the display elements arranged in the display region 15 are arranged differently.

Figure 5A:
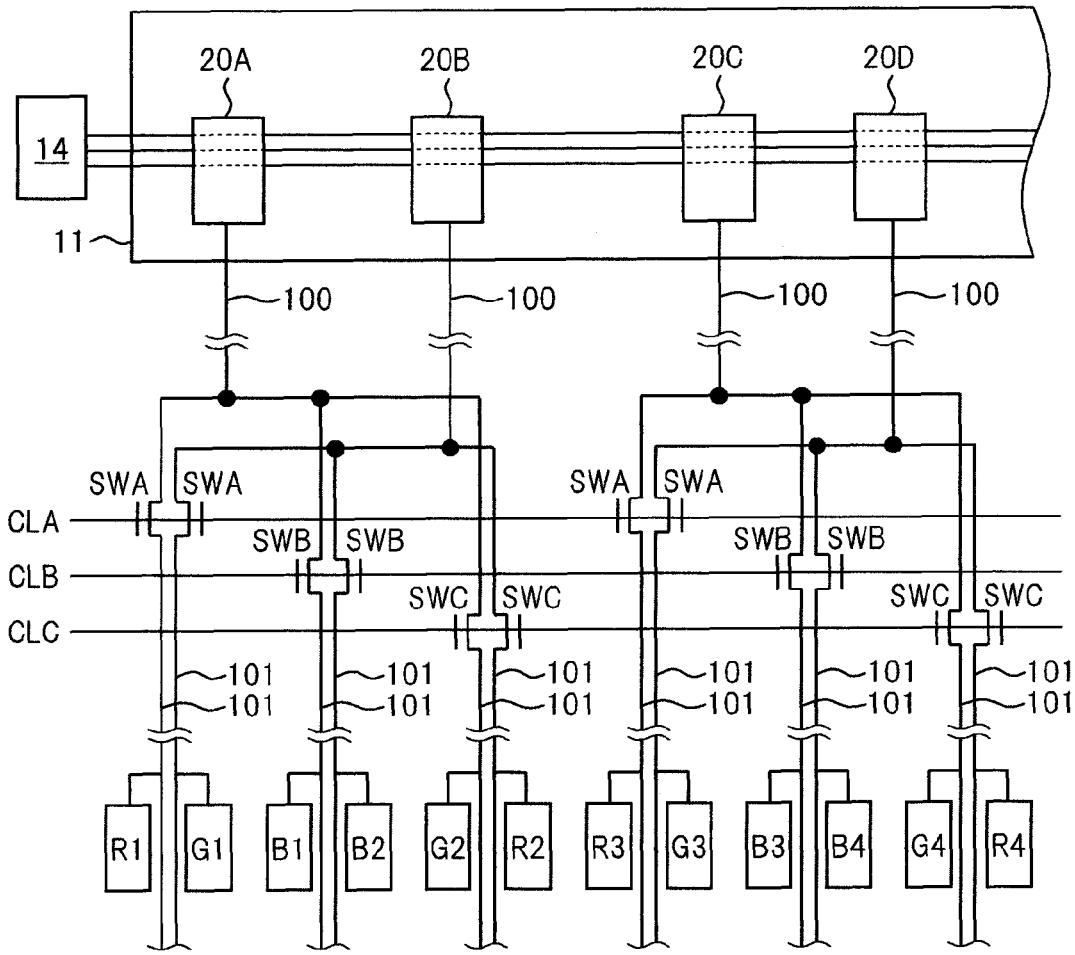
FIG. 5A is a schematic circuit diagram showing pixels which are arranged in a mirror pixel arrangement and a data line driving circuit which supplies display control voltages to these pixels, both of which are provided in an organic EL display device according to a second embodiment of the present invention.
Figure 5B:
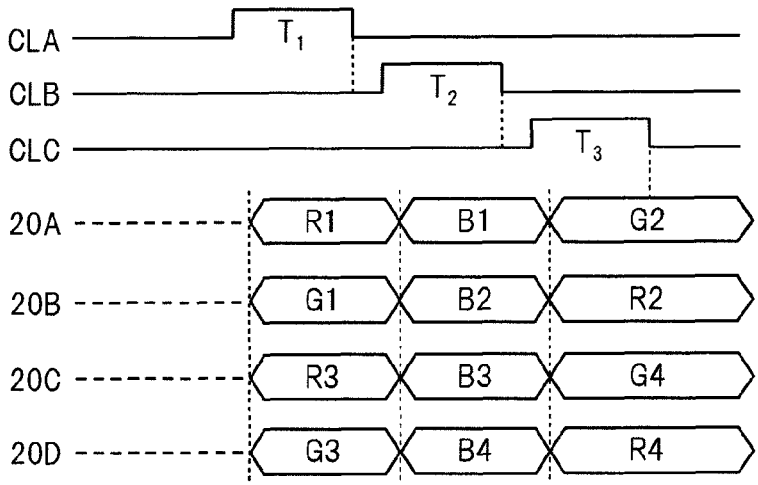
FIG. 5B is a diagram showing changes over time in the driving of element-select switching elements and the data line driving circuit shown in FIG. 5A.

FIG. 5A is a schematic circuit diagram showing pixels which are arranged in a mirror pixel arrangement and the data line driving circuit 11 which supplies display control voltages to these pixels, both of which are provided in the organic EL display device 1 according to the second embodiment of the present invention. FIG. 5B is a diagram showing changes over time in the driving of element-select switching elements and the data line driving circuit 11 shown in FIG. 5A.

The pixels shown in FIG. 5A are the same as the pixels shown in FIG. 3A, in that they are arranged in a data signal line mirror arrangement in which the display elements are positioned on both sides of the pair of sub-data signal lines 101. However, the pixel arrangement shown in FIG. 5A is different from the pixel arrangement shown in FIG. 3A, in that the arrangement of the display elements of the colors of red, green, and blue is reversed in neighboring pixels. For example, an arrangement in which the first pixel red display element R1, the first pixel green display element G1, and the first pixel blue display element B1 are arranged for the first pixel in that order from the left of FIG. 5A is reversed to an arrangement in which the second pixel blue display element B2, the second pixel green display element G2, and the second pixel red display element R2 are arranged for the second pixel in that order from the left of the figure, and such an arrangement is called a pixel mirror arrangement.

The pixel mirror arrangement is useful in the manufacturing processes of pixel circuits, specifically for guaranteeing the viability of a deposition process when the display elements are organic EL elements and guaranteeing the viability of a color filter production process when the display elements are liquid crystal display elements.

In this case, as shown in FIG. 5B, the first and second data line voltage generation circuits 20A and 20B need to supply display control voltages to each of the display elements of different colors only during the periods $T_1$ and $T_3$. Due to the configuration of the data line driving circuit 11 and the gradation voltage generation circuit unit 14 shown in FIG. 4, the plurality of data line voltage generation circuits 20 provided to the data line driving circuit can independently supply display control voltages to the corresponding display elements with respect to the display elements of different colors. Therefore, similarly to the organic EL display device 1 according to the first embodiment, in the organic EL display device 1 according to the second embodiment, the degree of freedom in designing the display device circuit can be increased remarkably, and it is possible to cope with the increase in the definition of the display panel of the display device.

Third Embodiment

A basic configuration of the organic EL display device 1 according to a third embodiment of the present invention is the same as the organic EL display device 1 according to the first embodiment. The organic EL display device 1 of the third embodiment of the present invention is different from the organic EL display device 1 of the first embodiment of the present invention, in that the data line driving circuit 11 and the gradation voltage generation circuit unit 14 are configured differently. In the organic EL display device 1 of the present embodiment, the pixel arrangement of the pixels provided in the display region 15 may have the pixel configuration of the pixels either according to the first embodiment as shown in FIG. 3A or according to the second embodiment as shown in FIG. 5A.

Figure 6:
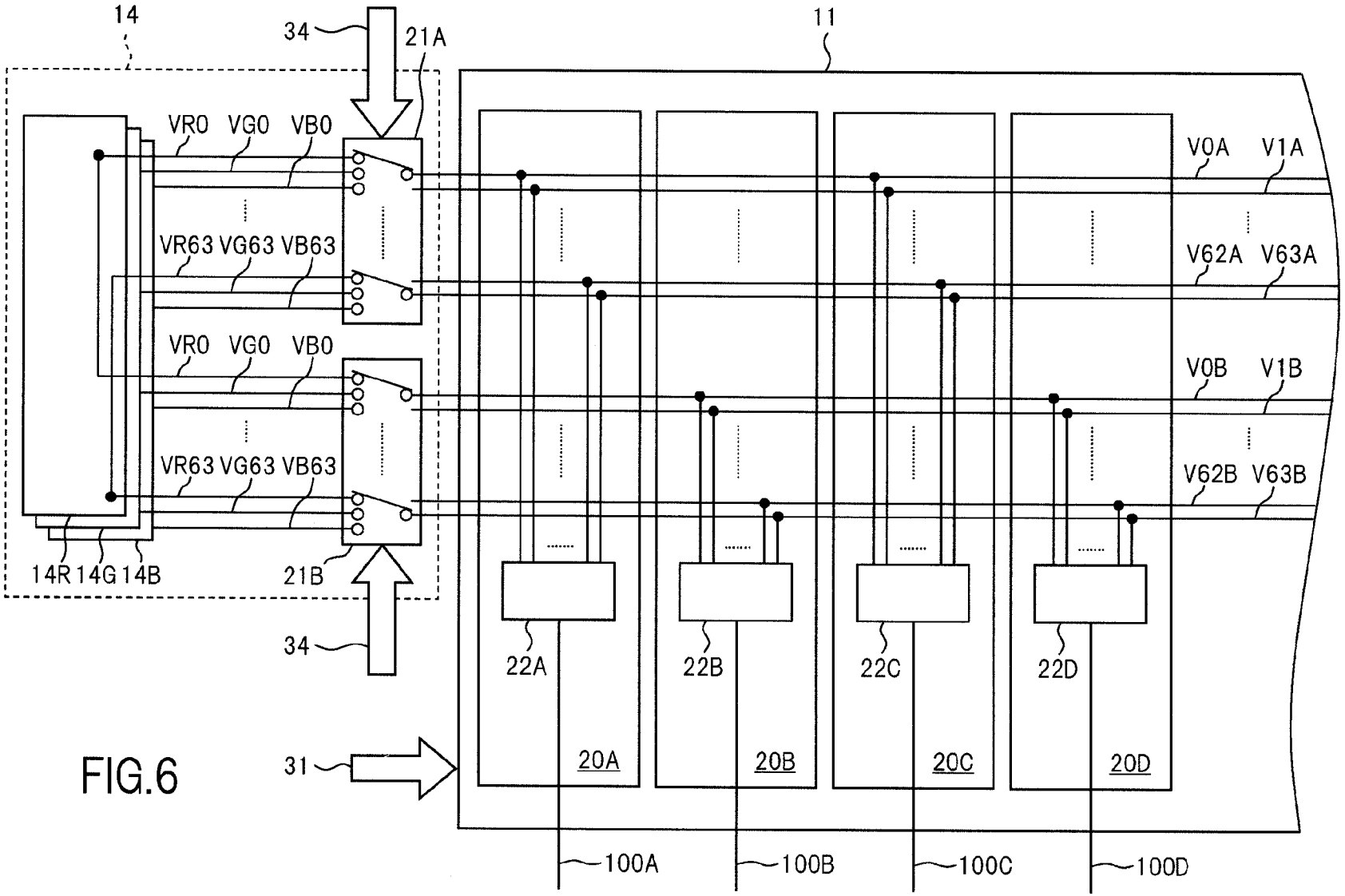
FIG. 6 is a schematic circuit diagram showing the configuration of a data line driving circuit and a gradation voltage generation circuit unit according to a third embodiment of the present invention.

FIG. 6 is a schematic circuit diagram showing the configuration of the data line driving circuit 11 and the gradation voltage generation circuit unit 14 according to the third embodiment of the present invention. A main difference from the configuration of the data line driving circuit 11 and the gradation voltage generation circuit unit 14 according to the first embodiment shown in FIG. 4 is that the gradation switching circuits 21 are provided to the gradation voltage generation circuit unit 14 rather than being provided to the data line voltage generation circuit 20.

As shown on the left side of FIG. 6, each of the red, green, and blue gradation voltage generation sub-circuits 14R, 14G, and 14B provided to the gradation voltage generation circuit unit 14 generates the gradation voltages of the 64 gradation numbers. Differently from FIG. 4, the gradation voltage corresponding to each gradation value is branched by the gradation voltage generation sub-circuits of each color so as to be output to each of two upper and lower wires. For example, the red gradation voltage generation sub-circuit 14R outputs the gradation voltage VR0 corresponding to the gradation value 0 to the two upper and lower wires through the inside of the gradation voltage generation circuit unit 14 of FIG. 6, and the two wires are denoted as VR0. The same applies to the green and blue gradation voltage generation sub-circuits 14G and 14B.

The first gradation switching circuit 21A and the second gradation switching circuit 21B are connected to the plurality of upper and lower wires, respectively. Similarly to the gradation switching circuits 21 shown in FIG. 4, the gradation switching circuits 21 include 64 switching elements corresponding to each of the gradation values. A switching element control signal 34 for controlling these switching elements is input to these gradation switching circuits 21 by the display controller 10 or the data line driving circuit 11. Each of these gradation switching circuits 21 outputs the gradation number of gradation voltages for a color designated by the input switching element control signal 34 to the data line driving circuit 11.

In this embodiment, a plurality of upper wires output by the first gradation switching circuit 21A are called odd-numbered wires, which are denoted as V0A, V1A, . . . , and V63A, from the upper side in FIG. 6. Similarly, a plurality of wires output by the second gradation switching circuit 21B are called even-numbered wires, which are denoted as V0B, V1B, . . . , and V63B, from the upper side in FIG. 6.

Each of the data line voltage generation circuits 20 provided to the data line driving circuit 11 connects to any one of the plurality of odd-numbered wires and plurality of even-numbered wires. The first and third data line voltage generation circuits 20A and 20C positioned on the first and third positions from the left of FIG. 6 are connected to the plurality of odd-numbered wires V0A, V1A, and V63A, and the second and fourth data line voltage generation circuits 20B and 20D positioned on the second and forth positions are connected to the plurality of even-numbered wires V0B, V1B, . . . , and V63B.

As shown in FIG. 3B, during the period $T_1$, each of the first data line voltage generation circuit 20A positioned on the odd-numbered position and the third data line voltage generation circuit 20C positioned on the third position and each of the second data line voltage generation circuit 20B positioned on the even-numbered position and the fourth data line voltage generation circuit 20D positioned on the fourth position supply display control voltages to the first and third pixel red display elements R1 and R3 and the first and third pixel green display elements G1 and G3, respectively. In the cases shown in FIGS. 3B and 5B, during the same period, the colors of the display elements to which the odd-numbered data line voltage generation circuits 20 supply the display control voltage are the same. Similarly, during the same period, the colors of the display elements to which the even-numbered data line voltage generation circuits 20 supply the display control voltage are the same.

Therefore, during the respective periods, the information on the colors of the display elements to which the odd-numbered data line voltage generation circuits 20 supply display control voltages is input to the first gradation switching circuit 21A by the switching element control signal 34, and the first gradation switching circuit 21A selects and outputs the gradation voltages of the 64 gradation numbers for the color to the plurality of odd-numbered wires, respectively. The gradation voltages of the color of the display elements are input to the odd-numbered data line voltage generation circuits 20 via the plurality of odd-numbered wires, and the gradation voltage DA converters 22 provided to the odd-numbered data line voltage generation circuits 20 select the gradation voltages corresponding to the digital value of the display data of the corresponding display elements and apply the selected gradation voltages to the corresponding data signal lines 100. The same applies to the even-numbered data line voltage generation circuits 20.

In the organic EL display device 1 according to the present embodiment, since during the same period, the odd and even-numbered data line voltage generation circuits 20 supply the display control voltages to the display elements of the same color, respectively, the two gradation switching circuits 21 can provide the gradation number of gradation voltages necessary for display to the plurality of data line voltage generation circuits 20 provided to the data line driving circuit 11. Therefore, it is possible to cope with the increase in the definition of the display panel of the display device while suppressing the increase in the circuit size of the display device.

When images are displayed on the pixels arranged in the general pixel arrangement shown in FIG. 14A, the two gradation switching circuits 21 may be controlled so as to simultaneously select gradation voltages of the same color.

Fourth Embodiment

A basic configuration of the organic EL display device 1 according to a fourth embodiment of the present invention is the same as the organic EL display device 1 according to the first embodiment. Similarly to the organic EL display device 1 of the third embodiment, the organic EL display device 1 of the fourth embodiment of the present invention is different from the organic EL display device 1 of the first embodiment of the present invention, in that the data line driving circuit 11 and the gradation voltage generation circuit unit 14 are configured differently. In the organic EL display device 1 of the present embodiment, the pixel arrangement of the pixels provided in the display region 15 may have the pixel arrangement of the pixels either according to the first embodiment as shown in FIG. 3A or according to the second embodiment as shown in FIG. 5A.

Figure 7:
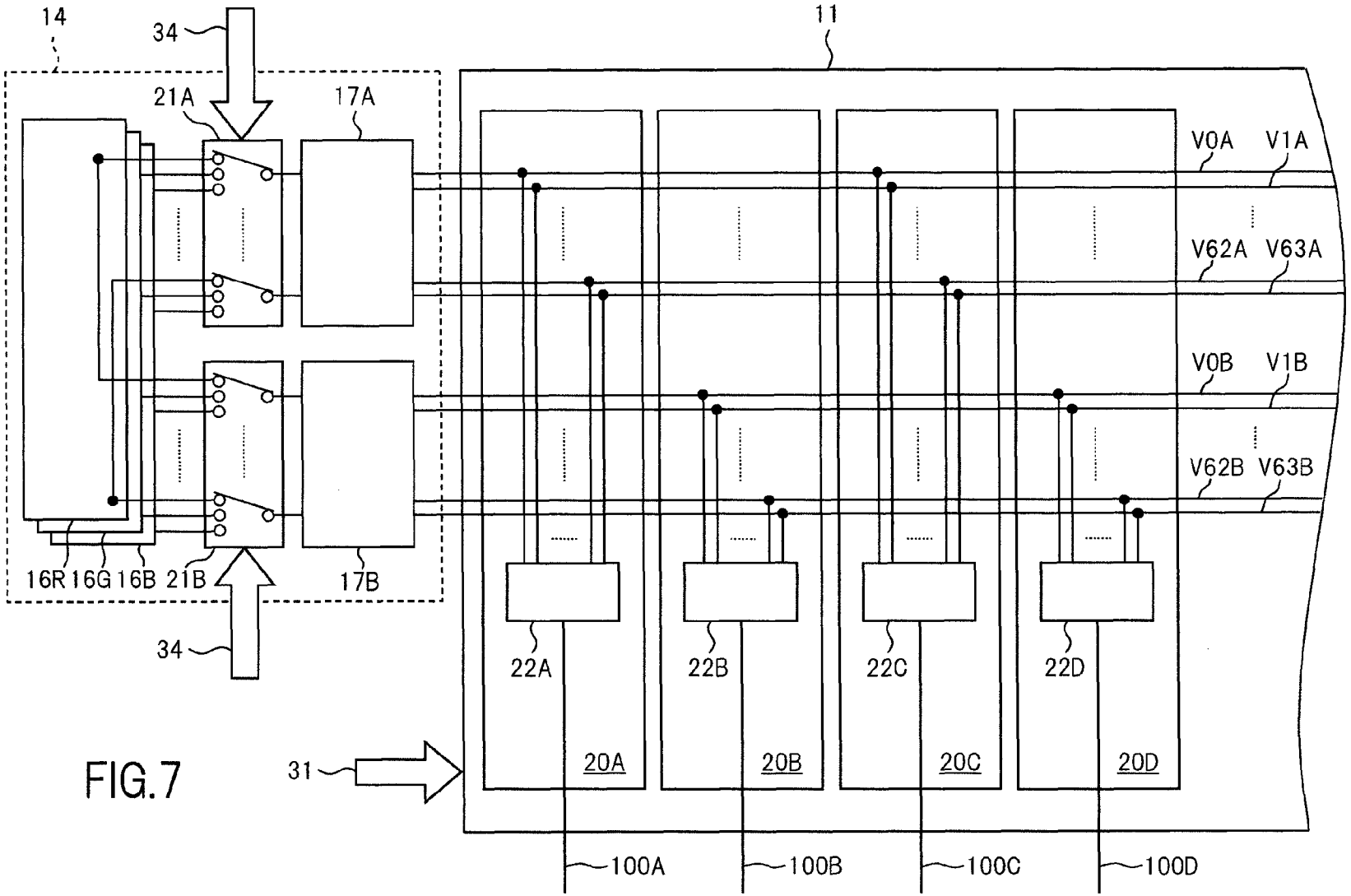
FIG. 7 is a schematic circuit diagram showing the configuration of a data line driving circuit and a gradation voltage generation circuit unit according to a fourth embodiment of the present invention.

FIG. 7 is a schematic circuit diagram showing the configuration of the data line driving circuit 11 and the gradation voltage generation circuit unit 14 according to the fourth embodiment of the present invention. A main difference from the configuration of the data line driving circuit 11 and the gradation voltage generation circuit unit 14 according to the first embodiment shown in FIG. 4 is that the gradation switching circuits 21 are provided to the gradation voltage generation circuit unit 14 rather than being provided to the data line voltage generation circuit 20.

As described above, the gradation voltage generation circuit unit generally includes a reference gradation voltage generation circuit (buffer circuit), which generates a predetermined reference gradation number of reference gradation voltages corresponding to reference gradation values, and a gradation voltage ingenerating circuit, which generates gradation voltages corresponding to all gradation values by dividing the adjacent reference gradation voltages by resistors connected in series.

In the gradation voltage generation circuit unit 14 shown in FIG. 7, red, green, and blue reference gradation voltage generation sub-circuits 16R, 16G, and 16B, which generate a predetermined reference gradation number of reference gradation voltages with respect to each of the three colors, respectively, output the predetermined reference gradation number of reference gradation voltages to the first and second gradation switching circuits 21A and 21B. Similarly to the case shown in FIG. 6, for example, the information on the colors of the display elements to which the odd-numbered data line voltage generation circuits 20 supply display control voltages is input to the first gradation switching circuit 21A by the switching element control signal 34, and the first gradation switching circuit 21A selects and outputs the reference gradation voltages of the reference gradation number for the color to a first gradation voltage ingenerating circuit 17A. The first gradation voltage ingenerating circuit 17A outputs the gradation voltages of the 64 gradation numbers to the odd-numbered wires, similarly to the case shown in FIG. 6. The plurality of data line voltage generation circuits 20 provided to the data line driving circuit 11 are the same as those shown in FIG. 6.

In the organic EL display device 1 according to the present embodiment, similarly to the third embodiment, the two gradation switching circuits 21 can provide the gradation number of gradation voltages necessary for display. Further, in the gradation voltage generation circuit unit 14 according to the present embodiment, since the gradation switching circuit 21 is provided on the output side of the reference gradation voltage generation sub-circuit for each color which generates the reference gradation voltages of the reference gradation number, it is not necessary to provide the gradation voltage generation circuit unit for each of the three colors, but the number of the gradation voltage generation circuit units can be reduced to 2. Therefore, it is possible to cope with the increase in the definition of the display panel of the display device while suppressing the increase in the circuit size of the display device.

When images are displayed on the pixels arranged in the general pixel arrangement shown in FIG. 14A, the two gradation switching circuits 21 may be controlled so as to simultaneously select gradation voltages of the same color.

In the present embodiment, a plurality of gradation voltage output units refers to the reference gradation voltage generation sub-circuits for the three colors, and a predetermined gradation number refers to a reference gradation number which is the number of reference gradation voltages. Moreover, a display control voltage supply unit which supplies display control voltage to corresponding display elements refers to the data line voltage generation circuit 20 provided to the data line driving circuit 11 and the gradation voltage ingenerating circuit 17.

Fifth Embodiment

The display device according to a fifth embodiment of the present invention may be the organic EL display device 1 according to any one of the first to fourth embodiments. The gradation voltage generation circuit unit 14 provided to the display device according to the fifth embodiment may be the gradation voltage generation circuit unit 14 which is configured as follows.

A display element has a gradation voltage which corresponds to a display luminance. For example, in the case of 6-bit gradation, the gradation number is 64, and there are 64 gradation voltages corresponding to the respective gradation values. For a certain gradation value, gradation voltages corresponding to the gradation values are referred to as a γ characteristic. The γ characteristic depends greatly on the material of the display element, the characteristics of a switching element connected to the display element, and the like, and differs in accordance with the type of the display element. For example, when an image of three colors is displayed, three display elements are used, and the γ characteristics of these three display elements are different from each other.

In the data line voltage generation circuit 20, the digital signal of the input display data is converted to an analog voltage to be applied to the data signal line, and the voltage is applied to the data signal line 100. When the DA conversion is performed, the gradation voltages of the gradation number output by the gradation voltage generation circuit unit 14 is input to the data line voltage generation circuit 20.

The gradation voltage generation circuit unit 14 of the related art generally includes a reference gradation voltage generation circuit (buffer circuit) which generates gradation voltages corresponding to several reference gradation values as reference gradation voltages and a gradation voltage ingenerating circuit which generates gradation voltages corresponding to all gradation values by amplifying the reference gradation voltages using an amplifier and dividing between the adjacent reference gradation voltages using resistors connected in series. Here, the gradation voltage ingenerating circuit generates the gradation voltages between the adjacent reference gradation voltages through a first-order approximation (linear approximation) by dividing between the adjacent reference gradation voltages using resistors connected in series.

In the gradation voltage generation circuit unit 14, the gradation voltages corresponding to the respective gradation values are generated so as to satisfy the γ characteristic. Further, the gradation number of the display data to be displayed on the display element is also increased with the increase in the definition of the display panel. For example, the gradation number is 16 for the case of 4-bit gradation, and the gradation number is 64 for the case of 6-bit gradation. Moreover, a resolution which is a difference between the gradation voltages corresponding to the adjacent gradation values becomes small accordingly.

As the gradation number increases, the number of reference gradation voltages which need to be generated in the reference gradation voltage generation circuit (buffer circuit) also increases. Further, as the resolution becomes small, the range where the first-order approximation is possible also becomes small, and accordingly, the number of reference gradation voltages increases further.

Moreover, in order for the gradation voltage generation circuit unit 14 to cope with the γ characteristics of different display elements, it is necessary that the range of the reference gradation voltages also increases, and the reference gradation voltages corresponding to such a large range can be generated.

In this way, when the gradation number increases, and the resolution becomes small accordingly, the circuit size of the gradation voltage generation circuit unit increases abruptly. The gradation voltage generation circuit unit 14 described below realizes a higher performance gradation voltage generation circuit unit while suppressing the increase in the circuit size.

Figure 8:
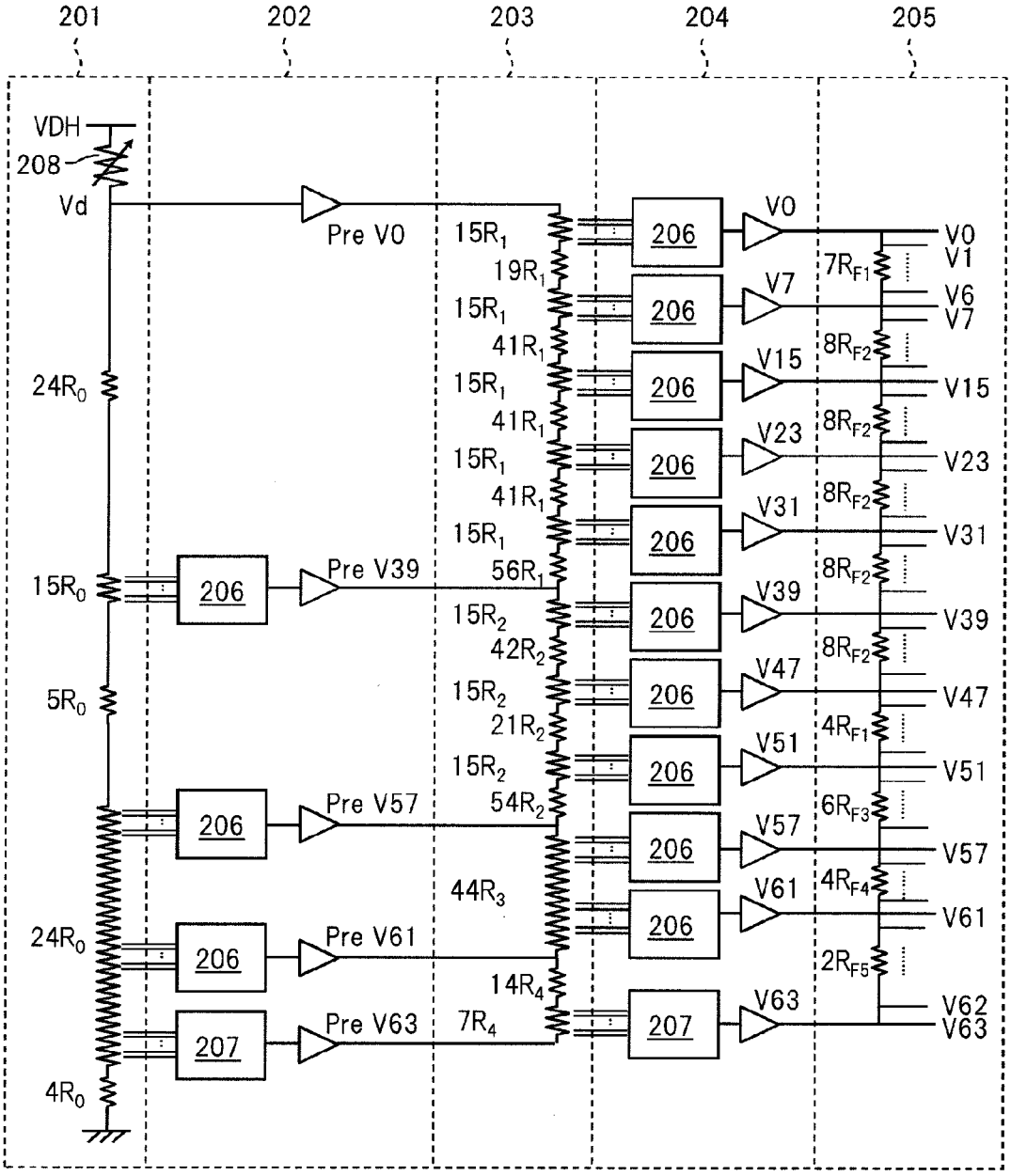
FIG. 8 is a circuit diagram of a gradation voltage generation circuit unit according to a fifth embodiment of the present invention.

FIG. 8 is a circuit diagram of the gradation voltage generation circuit unit 14 according to the fifth embodiment of the present invention. As shown in FIG. 8, the gradation voltage generation circuit unit 14 includes a primary ladder circuit 201, a primary buffer circuit 202, a secondary ladder circuit 203, a secondary buffer circuit 204, and a gradation voltage ingenerating circuit 205. FIG. 8 shows the gradation voltage generation circuit unit 14 which generates gradation voltages of 6-bit gradation, namely gradation number 64.

As shown in FIG. 8, in the primary ladder circuit 201, a reference gradation voltage adjustment circuit 208 and resistors 24$R_0$, 15$R_0$, 5$R_0$, 24$R_0$, and 4$R_0$ (where $R_0$=5 kΩ) are serially connected in that order between a direct-current voltage $V_{DH}$ and a ground voltage. Thus, the primary ladder circuit 201 supplies voltages obtained by dividing between the direct-current voltage $V_{DH}$ and the ground voltage using the series-connected resistors to the primary buffer circuit 202. Here, the direct-current voltage $V_{DH}$ is 5.3 V. The direct-current voltage $V_{DH}$ is connected to the reference gradation voltage adjustment circuit 208, and a reference voltage $V_d$ which is the highest gradation voltage is supplied to a primary 0-th reference voltage $PreV_0$ of the primary buffer circuit 202.

Figure 9:
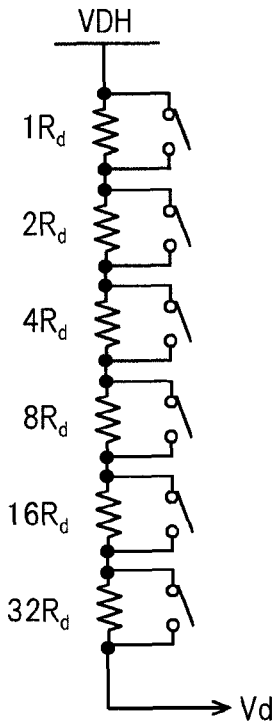
FIG. 9 is a circuit diagram of a reference gradation voltage adjustment circuit according to the fifth embodiment of the present invention.

FIG. 9 is a circuit diagram of the reference gradation voltage adjustment circuit 208 according to the fifth embodiment of the present invention. The reference gradation voltage adjustment circuit 208 is a known serial switching circuit which includes series-connected resistors $R_d$, 2$R_d$, 4$R_d$, 8$R_d$,

16$R_d$, and 32 $R_d$ (where $R_d$=2 kΩ) and switching elements that short-circuit the respective resistors. By controlling these switching elements, it is possible to generate a reference voltage $V_d$ of 3.95 V to 5.3 V in 64 steps in accordance with its relationship with the reference gradation voltage adjustment circuit 208 and the other series-connected resistors.

The primary buffer circuit 202 performs primary adjustment of the reference voltages by selecting voltages from the voltages supplied by the primary ladder circuit 201 with rough precision of intervals of 70 mV using a decoder, amplifies the voltages using an amplifier to obtain primary buffer output voltages (primary reference voltages), and outputs the primary buffer output voltages to the secondary ladder circuit 203.

As shown in FIG. 8, a 16-to-1 decoder 206 is connected between an output voltage of the primary ladder circuit 201 and a primary first reference voltage $PreV_{39}$ of the primary buffer circuit 202. For example, when the reference voltage $V_d$ is 5.3 V, the primary first reference voltage $PreV_{39}$ can be selected between 2.45 V and 3.50 V with intervals of 70 mV. By selecting the switches of the 16-to-1 decoder 206 in accordance with gradation voltages of the display element, it is possible to generate a primary second reference voltage $PreV_{57}$.

Figure 10:
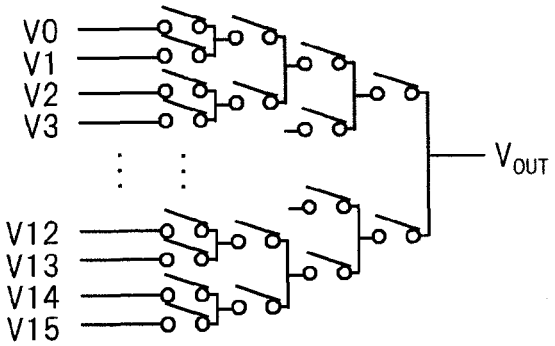
FIG. 10 is a circuit diagram of a 16-to-1 decoder according to the fifth embodiment of the present invention.

FIG. 10 is a circuit diagram of the 16-to-1 decoder 206 according to the fifth embodiment of the present invention. This decoder is a known tournament-type decoder. The switching elements are turned on by a 4-bit control signal, and a desired voltage is selected and output.

Similarly, the primary second reference voltage $PreV_{57}$ and a primary third reference voltage $PreV_{61}$ can be selected between 0.95 V and 2.00 V and between 0.30 V to 1.35 V, respectively, with intervals of 70 mV. Further, a primary fourth reference voltage $PreV_{63}$ is connected to an 8-to-1 decoder 207 and can be selected between 0.30 V to 0.79 V with intervals of 70 mV.

The secondary ladder circuit 203 supplies voltages obtained by further dividing between the adjacent primary buffer output voltages generated by the primary buffer circuit 202 using the series-connected resistors to the secondary buffer circuit 204. Here, resistors 15$R_1$, 19$R_1$, 15$R_1$, 41$R_1$, 15$R_1$, 41$R_1$, 15$R_1$, 41$R_1$, 15$R_1$, and 56$R_1$ (where $R_1$ is 2 kΩ, for example) are serially connected in that order from the high voltage side so as to divide between the primary 0-th reference voltage $PreV_0$ and the primary first reference voltage $PreV_{39}$. Similarly, resistors 15$R_2$, 42$R_2$, 15$R_2$, 21$R_2$, 15$R_2$, and 54$R_2$ (where $R_2$ is 5 kΩ), for example) are serially connected in that order so as to divide between the primary first reference voltage $PreV_{39}$ and the primary second reference voltage $PreV_{57}$. A resistor 44$R_3$ (where $R_3$ is 10 kΩ, for example) is connected so as to divide between the primary second reference voltage $PreV_{57}$ and the primary third reference voltage $PreV_{61}$. Resistors 14$R_4$ and 7$R_4$ ($R_4$ is 20 kΩ, for example) are connected so as to divide between the primary third reference voltage $PreV_{61}$ and the primary fourth reference voltage $PreV_{63}$.

The secondary buffer circuit 204 performs secondary adjustment of the reference voltages by selecting voltages from the voltages supplied by the secondary ladder circuit 203 with fine precision of intervals of 10 mV using a decoder, amplifies the voltages using an amplifier to obtain secondary buffer output voltages (secondary reference voltages), and outputs the secondary buffer output voltages to the gradation voltage ingenerating circuit 205.

Using the primary 0-th reference voltage $PreV_0$ as a reference, secondary adjustment is performed by the 16-to-1 decoder 206 with intervals of 10 mV within a range of equal to or lower than the primary 0-th reference voltage $PreV_0$ to generate a secondary 0-th reference voltage $V_0$. Moreover, in addition to the secondary 0-th reference voltage $V_0$, secondary adjustment is performed similarly by the 16-to-1 decoder 206 with intervals of 10 mV within a range between the primary 0-th reference voltage $PreV_0$ and the primary first reference voltage $PreV_{39}$ to generate the secondary buffer output voltages which are a secondary first reference voltage $V_7$, a secondary second reference voltage $V_{15}$, a secondary third reference voltage $V_{23}$, and a secondary fourth reference voltage $V_{31}$.

Similarly, using the primary first reference voltage $PreV_{39}$ as a reference, the 16-to-1 decoder 206 generates a secondary fifth reference voltage $V_{39}$ within a range of equal to or lower than the primary first reference voltage $PreV_{39}$. Further, secondary sixth and seventh reference voltages $V_{47}$ and $V_{51}$ are generated between the primary first and second reference voltages $PreV_{39}$ and $PreV_{57}$.

In addition, similarly, secondary eighth, ninth and tenth reference voltages $V_{57}$, $V_{61}$, and $V_{63}$ are generated. Here, the secondary tenth reference voltage $V_{63}$ is generated by the 8-to-1 decoder 207 by performing adjustment with intervals of 10 mV within a range of equal to higher than the primary fourth reference voltage $PreV_{63}$.

The gradation voltage ingenerating circuit 205 evenly divides between the secondary buffer output voltages generated by the secondary buffer circuit 204 in accordance with the difference between the gradation values by series-connected resistors to generate gradation voltages of the gradation number. The respective series-connected resistors provided between the secondary buffer output voltages are selected between adjacent secondary buffer output voltages. FIG. 8 shows a case where the voltages are divided by five resistors $R_{F1}$, $R_{F2}$, $R_{F3}$, $R_{F4}$, and $R_{F5}$, which are 140Ω, 120Ω, 160Ω, 240Ω and 480Ω, respectively. It should be noted that the gradation voltages are $V_0, V_1, V_2, \ldots$, and $V_{63}$ in that order from the highest voltage.

Figure 11:
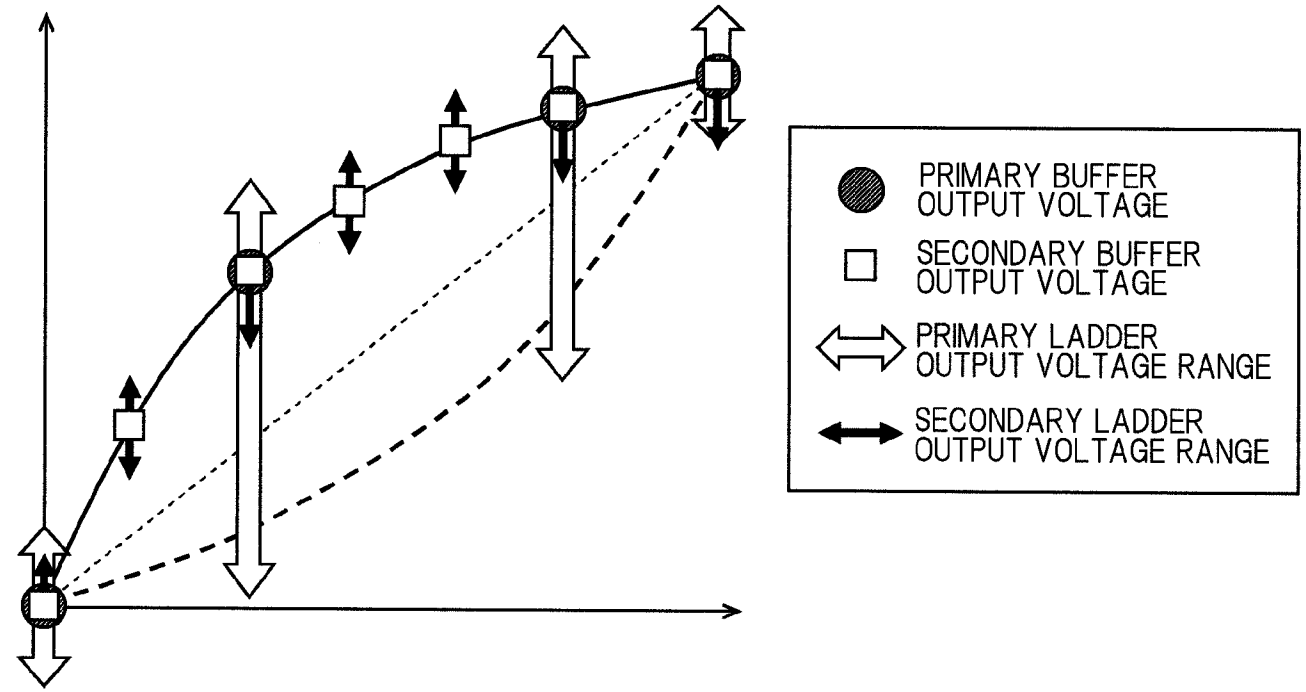
FIG. 11 is a diagram showing the adjustment process of the gradation voltage generation circuit unit according to the fifth embodiment of the present invention.

FIG. 11 is a diagram showing the adjustment process of the gradation voltage generation circuit unit 14 according to the fifth embodiment of the present invention. In the figure, the horizontal axis represents the gradation value, and the vertical axis represents the output voltage. As described above, the γ characteristics of the display elements differ from element to element. FIG. 11 shows three curves representing the γ characteristic including an upwardly convex curve, a linear curve, and a downwardly convex curve. The gradation voltage generation circuit unit 14 according to the present embodiment has a wide output voltage range defined by these three curves.

In this embodiment, generation of the gradation voltages of a display element having the upwardly convex γ characteristic shown by the solid line will be described as an example. As described above, the primary buffer circuit 202 generates primary buffer output voltages with respect to several reference gradation values. The primary buffer output voltages generated by the primary buffer circuit 202 are subjected to primary adjustment with rough precision within a wide output voltage range shown by the thick arrows in the figure.

The secondary buffer circuit 204 generates secondary buffer output voltages at several gradation values between the adjacent primary buffer output voltages, including the gradation values of the primary buffer output voltages, from the primary buffer output voltages generated by the primary buffer circuit 202. The secondary buffer output voltages generated by the secondary buffer circuit 204 are subjected to secondary adjustment with fine precision within a narrow output voltage range shown by the thin arrows in the figure. At the gradation values of the primary buffer output voltages, the secondary adjustment by the secondary buffer circuit 204 is performed in the direction of the lower voltages. However, the secondary adjustment is performed towards the higher voltages at the smallest gradation value. Moreover, in the case of the upwardly convex γ characteristic, the secondary buffer output voltages positioned between the adjacent primary buffer output voltages are adjusted towards the high voltage side from a position where the primary buffer output voltages are connected by a straight line.

The gradation voltage ingenerating circuit 205 can evenly divide the secondary buffer output voltages using series-connected resistors and generates gradation voltages of desired gradation number. Therefore, it is possible to realize a gradation voltage generation circuit unit capable of generating gradation voltages by optimizing the γ characteristic while suppressing the increase in the circuit size.

In this embodiment, although the gradation number of the gradation voltage generation circuit unit 14 is described as the gradation number 64 of 6-bit gradation, the gradation number is not limited to this gradation number.

Moreover, although the display device according to the present invention has been described by way of the organic EL display device, the display device is not limited to the organic EL display device, but the present invention can be applied to other display devices using self-emitting elements and display devices having other light sources such as liquid crystal display devices.

[Related Technique]

A related technique of the present invention described hereinabove will be described below.

Figure 12A:
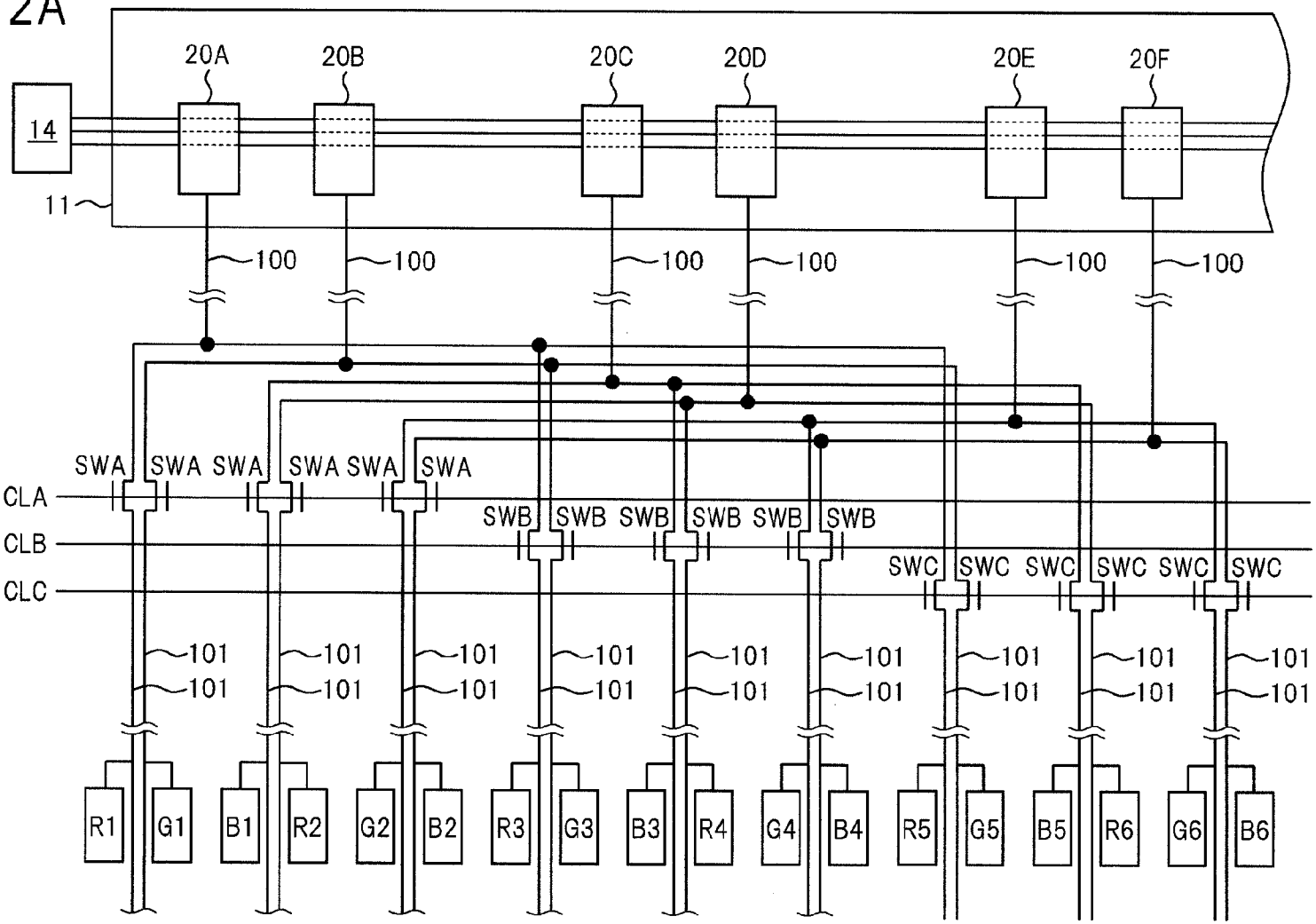
FIG. 12A is a schematic circuit diagram showing pixels which are arranged in a general pixel arrangement and a data line driving circuit which supplies display control voltages to these pixels according to a related technique of the present invention.
Figure 12B:
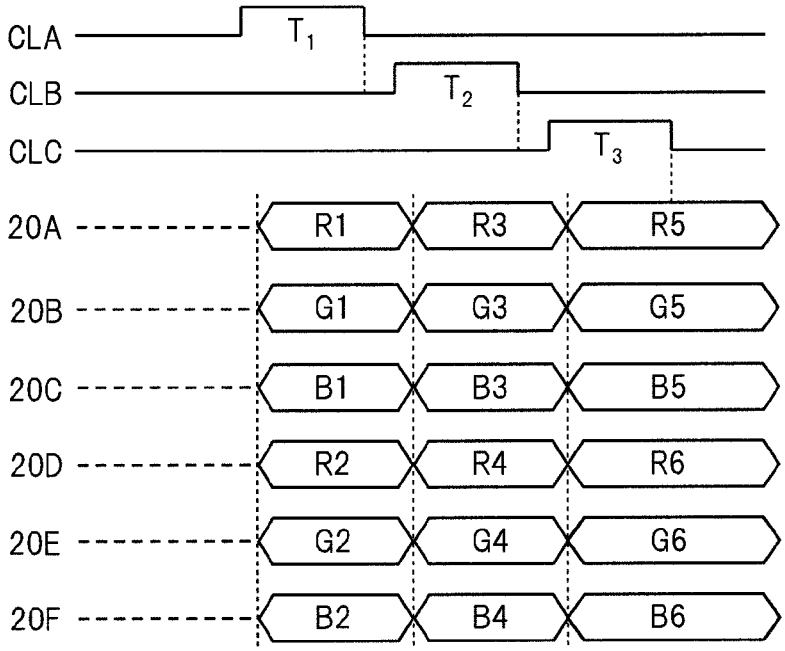
FIG. 12B is a diagram showing the changes over time in the driving of element-select switching elements and the data line driving circuit shown in FIG. 12A.

FIG. 12A is a schematic circuit diagram showing pixels which are arranged in a general pixel arrangement and the data line driving circuit 11 which supplies display control voltages to these pixels according to a related technique of the present invention. FIG. 12B is a diagram showing the changes over time in the driving of element-select switching elements and the data line driving circuit 11 shown in FIG. 12A.

The pixels shown in FIG. 12A are arranged in a data signal line mirror arrangement in which display elements are positioned on both sides of the pair of sub-data signal lines 101. As described above, by simultaneously supplying display control voltages to the display elements connected to each of the pair of sub-data signal lines 101, it is possible to suppress crosstalk.

As shown in FIG. 12A, 6 data signal lines 100 and 18 sub-data signal lines 101 are connected to the element-select switching elements SWA, SWB, and SWC which each include 6 switches.

By connecting in this way, as shown in FIG. 12B, during the periods $T_1$, $T_2$, and $T_3$, the first and fourth data line voltage generation circuits 20A and 20D supply the display control voltage only to the red display elements. Similarly, the second and fifth data line voltage generation circuits 20B and 20E and the third and sixth data line voltage generation circuits 20C and 20F supply the display control voltage only to the green display elements and the blue display elements, respectively.

That is, it is only necessary that only the gradation voltage of the same color is always input to the respective data line voltage generation circuits 20. In such a case, it is possible to simplify the generation of gradation voltages in the data line voltage generation circuits 20 and cope with the gradation voltage generation method disclosed in JP 2002-258813 A.

Figure 13A:
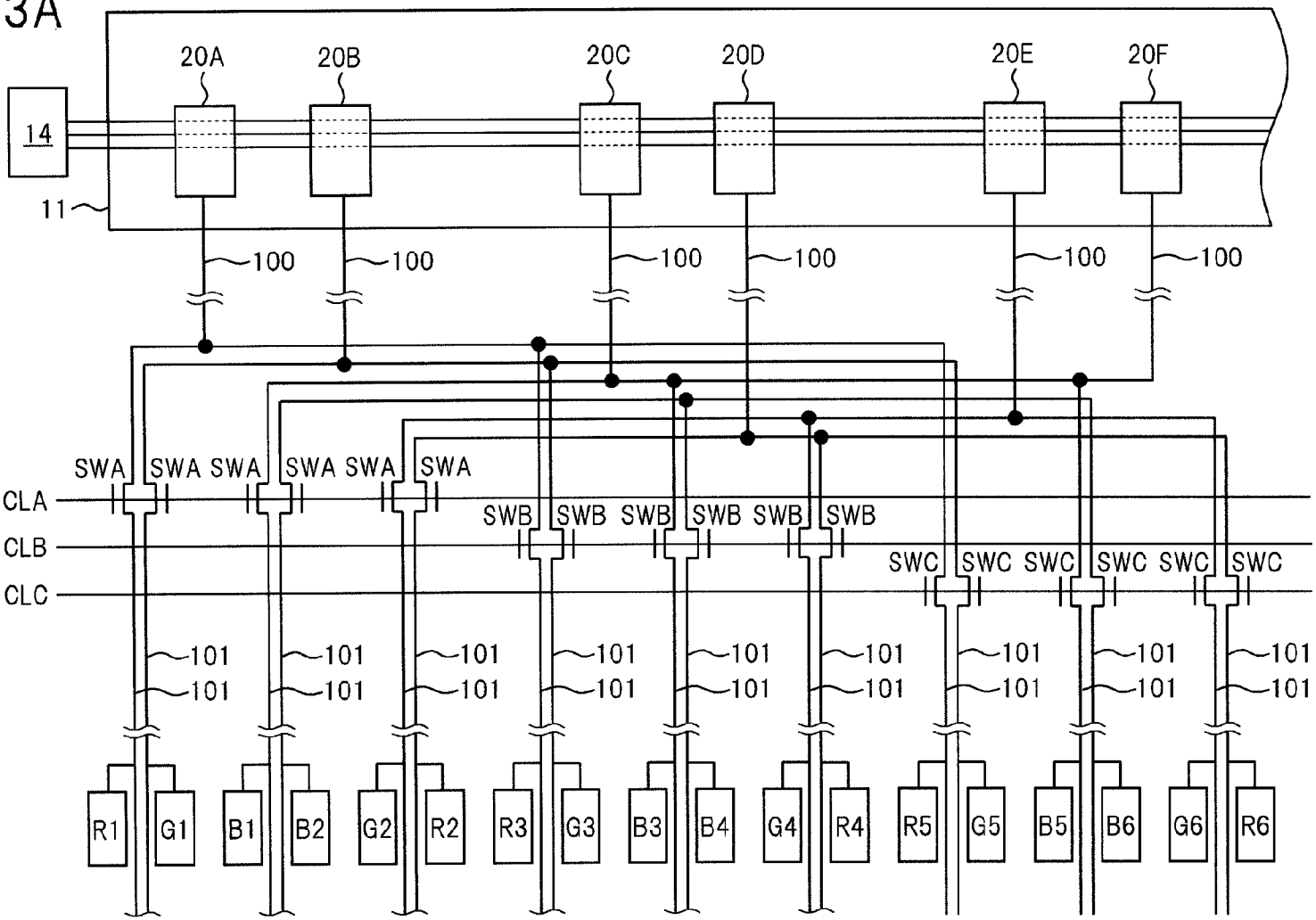
FIG. 13A is a schematic circuit diagram showing pixels which are arranged in a mirror pixel arrangement and a data line driving circuit which supplies display control voltages to these pixels according to a related technique of the present invention.
Figure 13B:
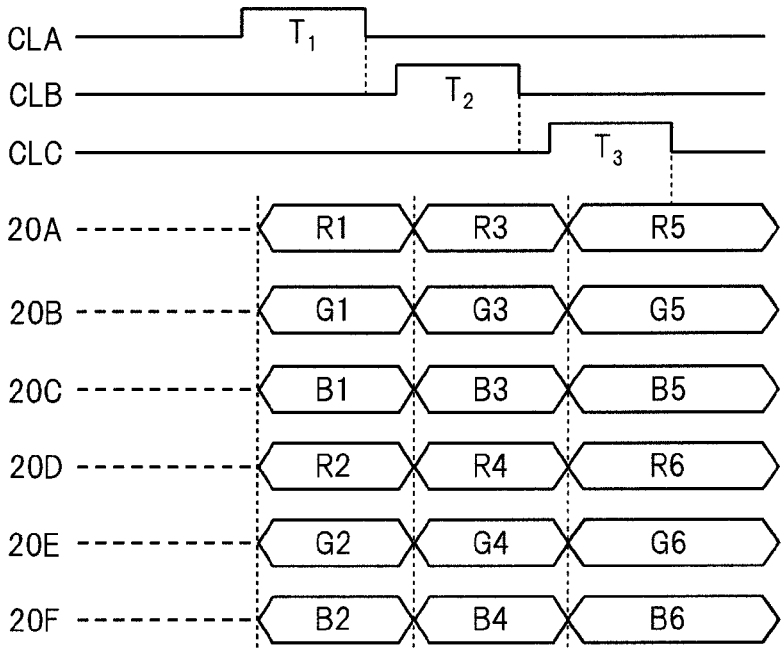
FIG. 13B is a diagram showing the changes over time in the driving of element-select switching elements and the data line driving circuit shown in FIG. 13A.

FIG. 13A is a schematic circuit diagram showing pixels which are arranged in a mirror pixel arrangement and the data line driving circuit 11 which supplies display control voltages to these pixels according to a related technique of the present invention. FIG. 13B is a diagram showing the changes over time in the driving of element-select switching elements and the data line driving circuit 11 shown in FIG. 13A.

The pixel arrangement shown in FIG. 13A is similar to the pixel arrangement shown in FIG. 5A, in that it is a pixel mirror arrangement in which the arrangement of the display elements of the colors of red, green, and blue is reversed in neighboring pixels. In this case, by connecting as shown in FIG. 13A, it is only necessary that only the gradation voltage of the same color is always input to the respective data line voltage generation circuits 20 as shown in FIG. 13B. In such a case, it is possible to cope with the gradation voltage generation method disclosed in JP 2002-258813 A similarly to the case shown in FIG. 12A.

While there have been described what are at present considered to be certain embodiments of the invention, it will be understood that various modifications may be made thereto, and it is intended that the appended claims cover all such modifications as fall within the true spirit and scope of the invention.

What is claimed is:

1. A display device comprising:

a plurality of display elements each displaying an image of any one color from among two or more colors;

a plurality of gradation voltage output units each provided for one of said two or more colors and configured to output gradation voltages corresponding to respective display gradation values of a predetermined gradation number, the gradation voltages being different from one another corresponding to color;

a plurality of display control voltage supply units each connected to each of two or more display elements among the plurality of display elements and configured to supply a control voltage corresponding to display data of each of the display elements to each of the display elements based on the gradation voltages of the gradation number output by any one of the plurality of gradation voltage output units; and a plurality of gradation voltage selection units each provided to a corresponding one display control voltage supply unit and configured to select the gradation voltages output by any one of the plurality of gradation voltage output units, wherein each of the plurality of gradation voltage selection units is configured to select any one of the plurality of gradation voltage output units in accordance with the color of the display elements which are supplied with the control voltages by the corresponding one display control voltage supply unit, wherein the plurality of display elements includes first and second display elements which are arranged so as to be immediately adjacent to each other, and wherein the plurality of display control voltage supply units includes a first display control voltage supply unit to which the first display element is electrically connected and a second display control voltage supply unit to which the second display element is electrically connected.

2. A display device comprising:

a plurality of display elements each displaying an image of any one color from among two or more colors;

a plurality of gradation voltage output circuits each provided for one of said two or more combined colors so as to output gradation voltages corresponding to respective display gradation values of a predetermined gradation number, the gradation voltages being different from one another corresponding to color; and a plurality of data line voltage generation circuits each having a gradation voltage selection circuit selecting and outputting the gradation voltages of the gradation number output by any one of the plurality of gradation voltage output circuits, each of the data line voltage generation circuits outputting a control voltage corresponding to display data of each of the display elements based on the gradation voltages of the gradation number output by the gradation voltage selection circuit, wherein, when outputting the control voltage corresponding to the display data of each of the display elements to which the data line voltage generation circuit is electrically connected, the gradation voltage selection circuit selects and outputs the gradation voltages of the gradation number output by the gradation voltage output circuit corresponding to the display color of each of the display elements from the plurality of gradation voltage output circuits, wherein the plurality of display elements includes first and second display elements which are arranged so as to be immediately adjacent to each other, and wherein the plurality of data line voltage generation circuits includes a first data line voltage generation circuit to which the first display element is electrically connected and a second data line voltage generation circuit to which the second display element is electrically connected.

3. The display device according to claim 2, wherein the display device further comprises:

a first data line that supplies a control voltage to the first display element, a second data line that supplies a control voltage to the second display element, a first select switching element that selects electrical connection between the first data line and the first data line voltage generation circuit, and a second select switching element that selects electrical connection between the second data line and the second data line voltage generation circuit, wherein the first and second data lines extend in parallel between the first and second display elements and are connected to the first and second display elements, respectively, and wherein a switch of the first select switching element and a switch of the second select switching element are connected by one control line.

4. The display device according to claim 3, wherein a control-on signal is input to the control line in accordance with the time when the first data line voltage generation circuit supplies a control voltage corresponding to the display data of the first display element to the first display element, and the second data line voltage generation circuit supplies a control voltage corresponding to the display data of the second display element to the second display element.

5. The display device according to claim 2, wherein the plurality of display elements includes a plurality of pairs of display elements, each of the plurality of pairs of display elements including the first and second display elements arranged so as to be immediately adjacent to each other, wherein the first data line voltage generation circuit to which the first display elements of the plurality of pairs of display elements are electrically connected and the second data line voltage generation circuit to which the second display elements of the plurality of pairs of display elements are electrically connected, wherein the display device further comprises a plurality of first data lines that supplies control voltages to the first display elements of the plurality of pairs of display elements, a plurality of second data lines that supplies control voltages to the second display elements of the plurality of pairs of display elements, a plurality of first select switching elements that select electrical connection between each of the plurality of first data lines and the first data line voltage generation circuit, and a plurality of second select switching elements that select electrical connection between each of the plurality of second data lines and the second data line voltage generation circuit, wherein the corresponding first and second data lines extend in parallel between the first and second display elements of the plurality of pairs of display elements and are connected to the first and second display elements, respectively, and wherein switches of the first select switching elements corresponding to the first display elements of the plurality of pairs of display elements and switches of the second select switching elements corresponding to the second display elements of the plurality of pairs of display elements are connected by one control line.

6. The display device according to claim 5, further comprising:

a first wire extending from the first data line voltage generation circuit to be branched further to extend to be connected to the first select switching elements corresponding to the first display elements of the plurality of pairs of display elements; and a second wire extending from the second data line voltage generation circuit to be branched further to extend to be connected to the second select switching elements corresponding to the second display elements of the plurality of pairs of display elements.

7. The display device according to claim 2, wherein the first and second display elements are configured to display images of different colors, wherein the plurality of data line voltage generation circuits includes a first data line voltage generation circuit to which the first display element is electrically connected and a second data line voltage generation circuit to which the second display element is electrically connected, wherein the display device further comprises a first data line that supplies a control voltage to the first display element, a second data line that supplies a control voltage to the second display element, a first select switching element that selects electrical connection between the first data line and the first data line voltage generation circuit, and a second select switching element that selects electrical connection between the second data line and the second data line voltage generation circuit, wherein the first and second data lines extend in parallel between the first and second display elements and are connected to the first and second display elements, respectively, and wherein a switch of the first select switching element and a switch of the second select switching element are connected by one control line.

8. The display device according to claim 7, wherein a control-on signal is input to the control line in accordance with the time when the first data line voltage generation circuit supplies a control voltage corresponding to the display data of the first display element to the first display element, and the second data line voltage generation circuit supplies a control voltage corresponding to the display data of the second display element to the second display element.

9. The display device according to claim 2, wherein the plurality of display elements includes a plurality of pairs of display elements, each of the plurality of pairs of display elements including the first and second display elements configured to display images of different colors, wherein the first data line voltage generation circuit to which the first display elements of the plurality of pairs of display elements are electrically connected and the second data line voltage generation circuit to which the second display elements of the plurality of pairs of display elements are electrically connected, wherein the display device further comprises a plurality of first data lines that supplies control voltages to the first display elements of the plurality of pairs of display elements, a plurality of second data lines that supplies control voltages to the second display elements of the plurality of pairs of display elements, a plurality of first select switching elements that select electrical connection between each of the plurality of first data lines and the first data line voltage generation circuit, and a plurality of second select switching elements that select electrical connection between each of the plurality of second data lines and the second data line voltage generation circuit, wherein the corresponding first and second data lines extend in parallel between the first and second display elements of the plurality of pairs of display elements and are connected to the first and second display elements, respectively, and wherein switches of the first select switching elements corresponding to the first display elements of the plurality of pairs of display elements and switches of the second select switching elements corresponding to the second display elements of the plurality of pairs of display elements are connected by one control line.

10. The display device according to claim 9, wherein a control-on signal is input to the corresponding control line in accordance with the time when the first data line voltage generation circuit supplies a control voltage corresponding to the display data of the first display element to the first display element of one pair of display elements, and the second data line voltage generation circuit supplies a control voltage corresponding to the display data of the second display element to the second display element of the plurality of pair of display elements, and wherein a control-on signal is input to the corresponding control line in accordance with the time when the first data line voltage generation circuit supplies a control voltage corresponding to the display data of the first display elements to the first display elements of the other pairs of display elements, and the second data line voltage generation circuit supplies a control voltage corresponding to the display data of the second display elements to the second display elements of the other pairs of display elements.

11. The display device according to claim 9, further comprising:

a first wire extending from the first data line voltage generation circuit to be branched further to extend to be connected to the first select switching elements corresponding to the first display elements of the plurality of pairs of display elements; and a second wire extending from the second data line voltage generation circuit to be branched further to extend to be connected to the second select switching elements corresponding to the second display elements of the plurality of pairs of display elements.

12. A display device comprising:

a plurality of display elements each displaying an image of any one color from among two or more colors;

a plurality of gradation voltage output units each provided for one of said two or more colors and configured to output gradation voltages corresponding to respective display gradation values of a predetermined gradation number, the gradation voltages being different from one another corresponding to color;

a plurality of display control voltage supply units each connected to each of two or more display elements among the plurality of display elements and configured to supply a control voltage corresponding to display data of each of the display elements to each of the display elements based on the gradation voltages of the gradation number output by any one of the plurality of gradation voltage output units; and a plurality of gradation voltage selection units each provided to corresponding two or more display control voltage supply units and configured to select the gradation voltages output by any one of the plurality of gradation voltage output units, wherein each of the plurality of gradation voltage selection units is configured to select any one of the plurality of gradation voltage output units in accordance with the color of the display elements which are supplied with the control voltages by the corresponding two or more display control voltage supply units, wherein the plurality of display elements includes first and second display elements which are arranged so as to be immediately adjacent to each other, and wherein the plurality of display control voltage supply units includes a first display control voltage supply unit to which the first display element is electrically connected and a second display control voltage supply unit to which the second display element is electrically connected.

* * * * *